US011760460B1

(12) United States Patent
Powers

(10) Patent No.: US 11,760,460 B1
(45) Date of Patent: Sep. 19, 2023

(54) MARINE PROPELLERS WITH SHEARABLE DRIVE ASSEMBLIES

(71) Applicant: Charles S. Powers, Shreveport, LA (US)

(72) Inventor: Charles S. Powers, Shreveport, LA (US)

( * ) Notice: Subject to any disclaimer, the term of this patent is extended or adjusted under 35 U.S.C. 154(b) by 0 days.

(21) Appl. No.: 17/850,349

(22) Filed: Jun. 27, 2022

Related U.S. Application Data

(60) Provisional application No. 63/215,574, filed on Jun. 28, 2021.

(51) Int. Cl.
*B63H 1/20* (2006.01)
*B63H 23/34* (2006.01)

(52) U.S. Cl.
CPC ..... *B63H 23/34* (2013.01); *B63H 2023/342* (2013.01)

(58) Field of Classification Search
CPC ..... B63H 1/14; B63H 23/34; F16D 47/02; F16D 3/68; F16D 9/06
See application file for complete search history.

(56) References Cited

U.S. PATENT DOCUMENTS

| | | | | |
|---|---|---|---|---|
| 2,326,450 | A | 8/1943 | Fawick | |
| 2,848,883 | A | 8/1958 | Dall'olio | |
| 3,260,044 | A | 7/1966 | Garraway | |
| 4,086,012 | A | 4/1978 | Buckley | |
| 4,344,306 | A | 8/1982 | Citron | |
| 4,389,203 | A | 6/1983 | Duntzen | |
| 4,452,591 | A | 6/1984 | Fishbaugh | |
| 4,566,855 | A | 1/1986 | Costabile | |
| 4,750,685 | A | 6/1988 | Frei | |
| 5,252,028 | A | 10/1993 | LoBosco et al. | |
| 7,086,836 | B1 | 8/2006 | Sheth | |
| 7,223,073 | B2 | 5/2007 | Dean | |
| 7,488,225 | B2 * | 2/2009 | Lin | B63H 1/15 416/135 |
| 7,578,744 | B2 * | 8/2009 | Park | B62D 1/16 384/10 |
| 7,883,422 | B2 | 2/2011 | Takamura | |
| 8,277,269 | B1 * | 10/2012 | Alby | B63H 23/34 440/79 |
| 10,336,418 | B2 | 7/2019 | Kuroki | |
| 10,533,615 | B1 * | 1/2020 | Powers | F16D 9/06 |
| 2005/0186861 | A1 * | 8/2005 | Powers | F16D 47/02 440/49 |
| 2017/0066516 | A1 * | 3/2017 | Kuroki | B63H 1/15 |

* cited by examiner

*Primary Examiner* — Shafiq Mian
(74) *Attorney, Agent, or Firm* — R. Keith Harrison

(57) ABSTRACT

Marine propellers for coupling to a propeller drive shaft may include a propeller hub. A plurality of propeller blades may extend from the propeller hub. A shearable drive assembly may include a drive core. The drive core may include a drive core wall configured to be drivingly engaged by the propeller drive shaft. At least one drive rib may extend from the drive core wall. At least one shear cavity may be provided in the at least one drive rib. A drive sleeve may be drivingly engaged for rotation by the drive core and configured to drivingly engage the propeller hub of the marine propeller for rotation. The drive sleeve may have at least one rib slot receiving the at least one drive rib of the drive core. Other marine propellers with shearable drive assemblies are also disclosed.

28 Claims, 17 Drawing Sheets

MARINE PROPELLERS WITH SHEARABLE DRIVE ASSEMBLIES

CROSS-REFERENCE TO RELATED APPLICATIONS

This application claims the benefit of U.S. provisional application No. 63/215,574, filed Jun. 28, 2021 and entitled SHEARABLE DRIVE ASSEMBLIES AND MARINE PROPELLERS WITH SHEARABLE DRIVE ASSEMBLIES, which provisional application is hereby incorporated by reference herein in its entirety.

FIELD

Illustrative embodiments of the disclosure relate to drive assemblies which transmit torsional drive forces from a drive to an output. More particularly, illustrative embodiments of the disclosure relate to shearable drive assemblies which may couple a marine propeller to a propeller drive shaft to transmit torsional drive forces from the drive shaft to the propeller while absorbing vibration and providing engineered shearing characteristics for optimum driveline protection, and marine propellers with shearable drive assemblies.

SUMMARY

Illustrative embodiments of the disclosure are generally directed to shearable drive assemblies suitable for coupling a marine propeller having a propeller hub to a propeller drive shaft and marine propellers with shearable drive assemblies. An illustrative embodiment of the marine propellers with shearable drive assemblies may include a propeller hub. A plurality of propeller blades may extend from the propeller hub. A shearable drive assembly may include a drive core. The drive core may include a drive core wall configured to be drivingly engaged by the propeller drive shaft. At least one drive rib may extend from the drive core wall. At least one shear cavity may be provided in the at least one drive rib. A drive sleeve may be drivingly engaged for rotation by the drive core and configured to drivingly engage the propeller hub of the marine propeller for rotation. The drive sleeve may have at least one rib slot receiving the at least one drive rib of the drive core.

In some embodiments, the marine propellers may include a propeller hub. A plurality of propeller blades may extend from the propeller hub. A shearable drive assembly may include a drive core. The drive core may include a core wall configured to be drivingly engaged by the propeller drive shaft. At least one drive rib may extend from the core wall. At least one sacrificial rib may extend from the core wall. A drive sleeve may be drivingly engaged for rotation by the drive core. The drive sleeve may drivingly engage the propeller hub of the marine propeller for rotation. The drive sleeve may have at least one rib slot receiving the drive rib or ribs and at least one rib slot receiving the sacrificial rib or ribs of the drive core.

In some embodiments, the marine propellers may include a propeller hub having at least one interior lug slot. A plurality of propeller blades may extend from the propeller hub. A shearable drive assembly may include a drive core. The drive core may include a core wall configured to be drivingly engaged by the propeller drive shaft. At least one drive rib may extend from the core wall. A drive sleeve may be drivingly engaged for rotation by the drive core. The drive sleeve may drivingly engage the propeller hub of the marine propeller for rotation. The drive sleeve may have at least one interior rib slot receiving the drive rib or ribs of the drive core and at least one exterior sleeve lug inserted in the interior lug slot or slots in the propeller hub. The drive core may be circumferentially offset with respect to the drive sleeve with each drive rib corresponding positionally and off-center with respect to a corresponding one of the exterior sleeve lug or lugs of the drive sleeve.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
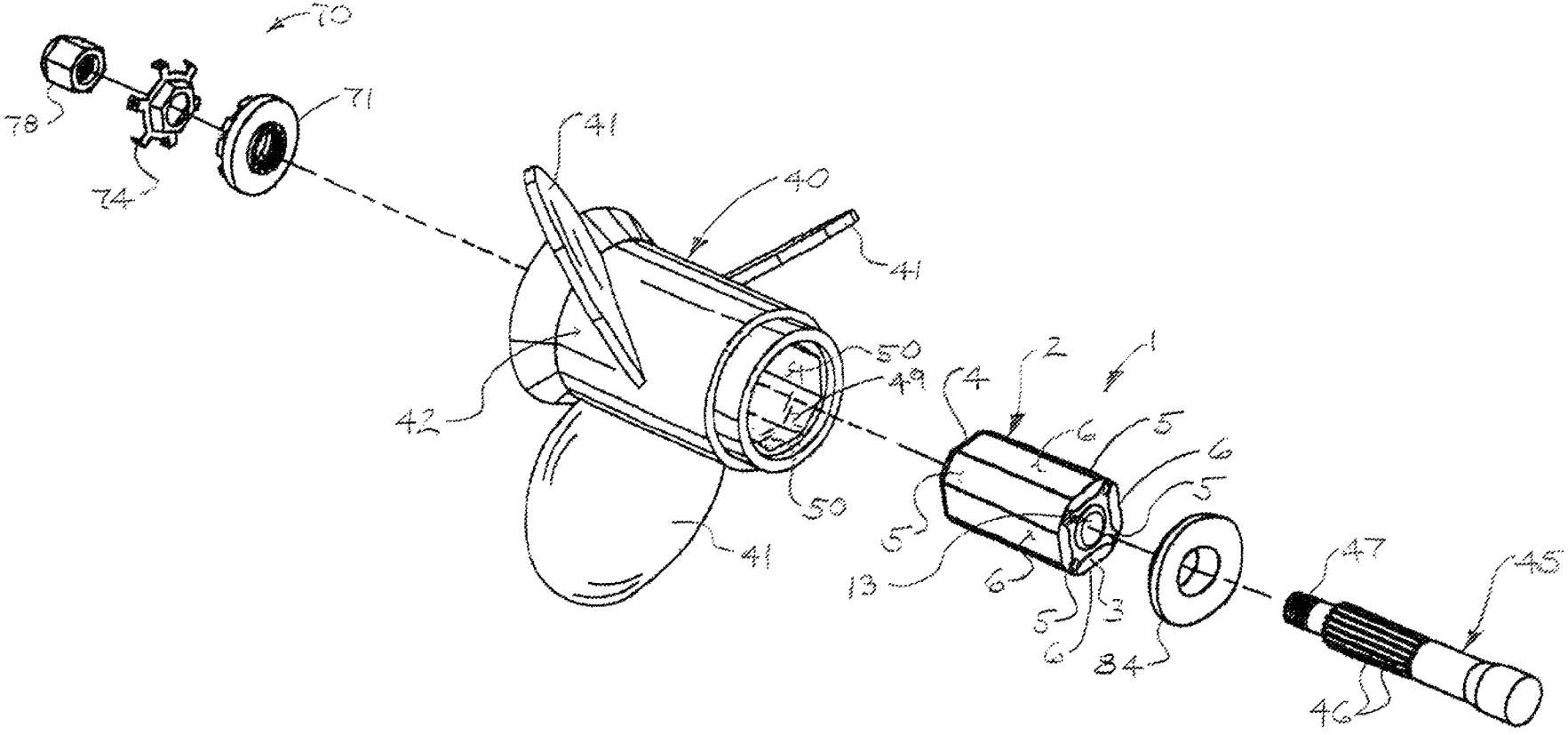
FIG. 1 is an exploded front perspective view of an illustrative embodiment of the marine propellers with shearable drive assemblies, with the shearable drive assembly in a disassembled state and removed from the marine propeller.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left" "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-9 of the drawings, an illustrative embodiment of the shearable drive assemblies of the disclosure is generally indicated by reference numeral 1. In some applications, the shearable drive assembly 1 may drivingly couple a marine or boat propeller 40, having propeller blades 41 extending from a propeller hub 42, to a propeller drive shaft 45, typically provided with drive shaft splines 46 and drive shaft threads 47 and drivingly engaged by an outboard boat motor on a marine vehicle (not illustrated). Accordingly, the shearable drive assembly 1 may be configured to transmit forward and reverse torsional forces from the propeller drive shaft 45 to the marine propeller 40 in operation of the outboard motor. The shearable drive assembly 1 may couple a drive to an output in any of a variety of other applications.

Figure 2:
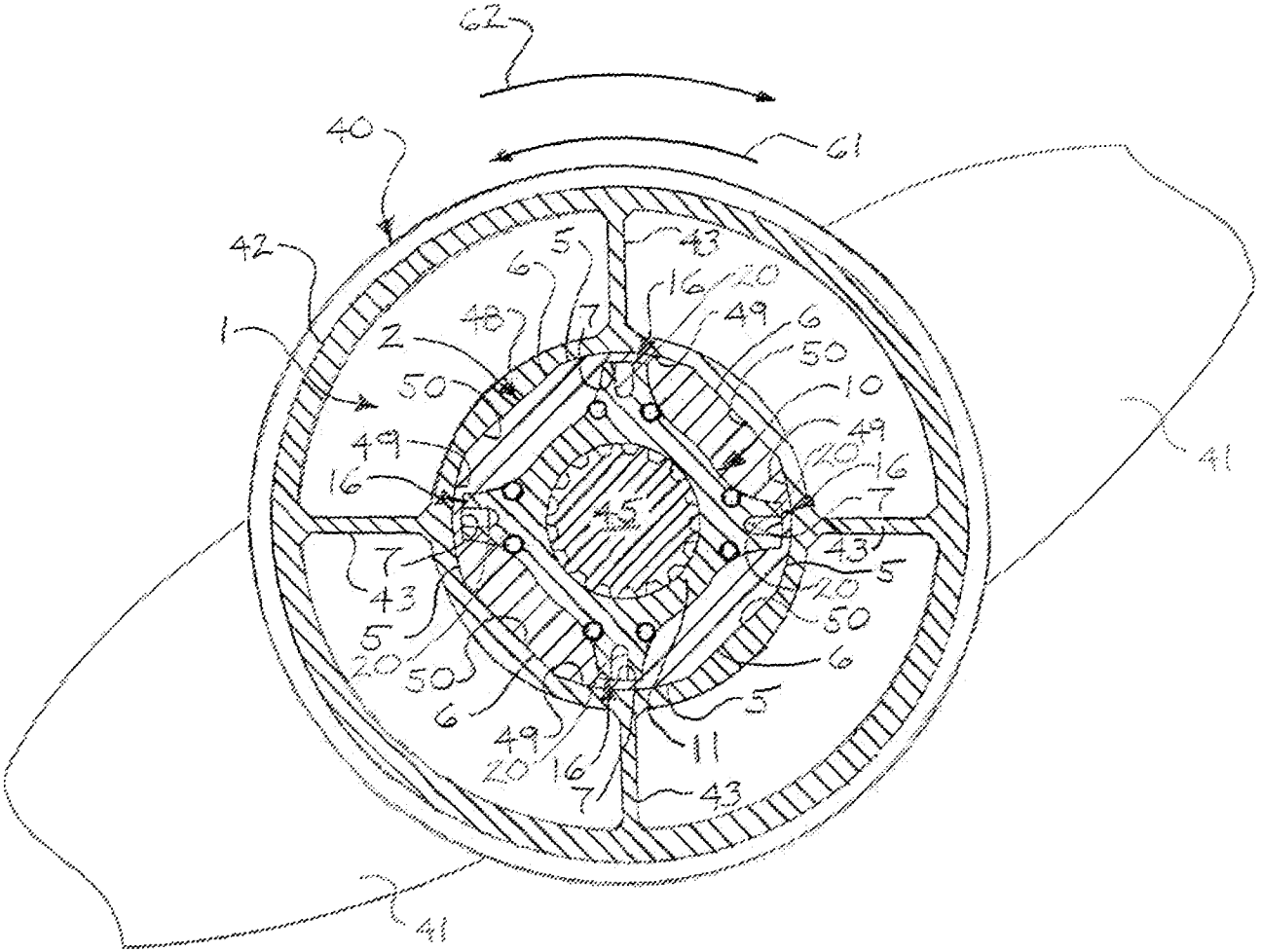
FIG. 2 is a cross-sectional view of the propeller hub of the assembled marine propeller illustrated in FIG. 1 and the illustrative shearable drive assembly deployed in place in the propeller hub.

As illustrated in FIG. 2, a central propeller hub drive sleeve 48 may be disposed in the propeller hub 42 of the marine propeller 40. Multiple hub vanes 43 may extend between the propeller hub drive sleeve 48 and the propeller hub 42. In some embodiments, the propeller hub drive sleeve 48 of the marine propeller 40 may be wedge-shaped and may gradually narrow or taper from the aft end to the fore end of the propeller hub 42. In other embodiments, the propeller hub drive sleeve 48 may be non-tapered and uniform in width from the aft end to the fore end of the propeller hub 42. The interior surface of the propeller hub drive sleeve 48 may include alternating interior lug slots 49 and hug drive sleeve flats 50 which may extend along at least a portion of the length of the propeller hub drive sleeve 48 for purposes which will be hereinafter described.

As will be hereinafter further described, the shearable drive assembly 1 may provide a forward or reverse torsional drive force from the propeller drive shaft 45 to the propeller hub 42 while imparting shear capability between those components to prevent or minimize damage to the propeller drive system during power surges and loads typically in the event that one of the propeller blades 41 of the rotating propeller 40 inadvertently strikes a submerged object (not illustrated) in operation of the marine vehicle on a water body. The shearable drive assembly 1 may additionally eliminate or reduce deadband or "play" between the propeller 40 and the propeller drive shaft 45 upon termination of torque applied to the propeller drive shaft 45, as well as attenuate or dampen torsional forces transmitted from the propeller drive shaft 45 to the marine propeller 40 to reduce shock and impact sounds and absorb vibration during gear changing or propeller striking events.

The shearable drive assembly 1 may include a drive sleeve 2. The drive sleeve 2 may be elongated with a fore sleeve end 3 and an aft sleeve end 4. Sleeve lugs 5 and sleeve flats 6 may be formed or shaped in the exterior surface of the drive sleeve 2 in alternating relationship to each other according to the knowledge of those skilled in the art. As illustrated in FIG. 2, in the assembled shearable drive assembly 1, the exterior sleeve lugs 5 and sleeve flats 6 on the drive sleeve 2 may engage the respective companion lug slots 49 and hub drive sleeve flats 50 in the interior surface of the propeller hub drive sleeve 48. The drive sleeve 2 may include at least one elastomeric material such as rubber, for example and without limitation.

At least one rib slot 7 may extend into the interior surface of the drive sleeve 2 for purposes which will be hereinafter described. The rib slot 7 may extend along at least a portion of the length of the shearable drive assembly 1. In some embodiments, the rib slots 7 may centrally align or register with the respective sleeve lugs 5 on the exterior surface of the drive sleeve 2.

A drive core 10 may be disposed in the drive sleeve 2 of the shearable drive assembly 1. The drive core 10 may include a core wall 11. The core wall 11 may extend at least a portion of, and typically, the entire length of the drive sleeve 2. The core wall 11 may include at least one hard and/or rigid material such as metal and/or composite. For example and without limitation, in some embodiments, the core wall 11 may include at least one metal such as stainless steel, aluminum alloy, bronze or combinations thereof.

Figure 3:
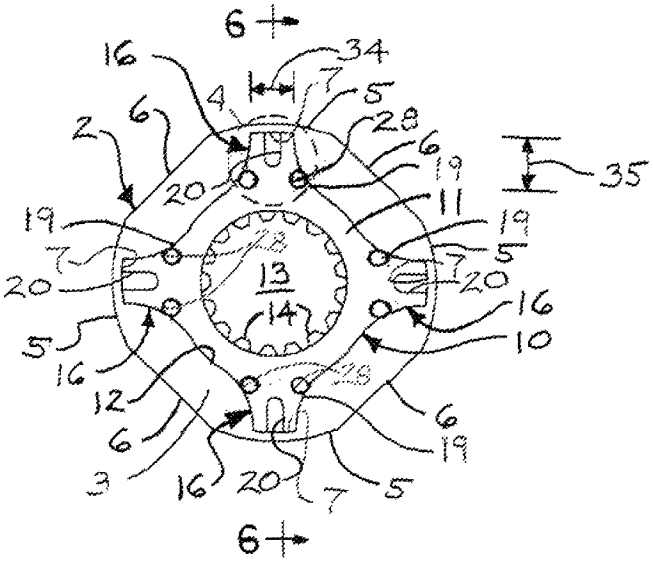
FIG. 3 is a fore end view of the illustrative shearable drive assembly.

As illustrated in FIG. 3, the interior surface of the drive sleeve 2 may join or engage the exterior surface of the drive core 10 at a sleeve/hub interface 12. The attachment between the drive sleeve 2 and the drive core 10 at the sleeve/hub interface 12 may utilize any of a variety of techniques or a combination of techniques for the purpose. For example and without limitation, the attachment may be facilitated through vulcanization, adhesive bonding, mechanical attachment using ribbed or raised keys and shoulders, or any combination thereof.

Figure 6:
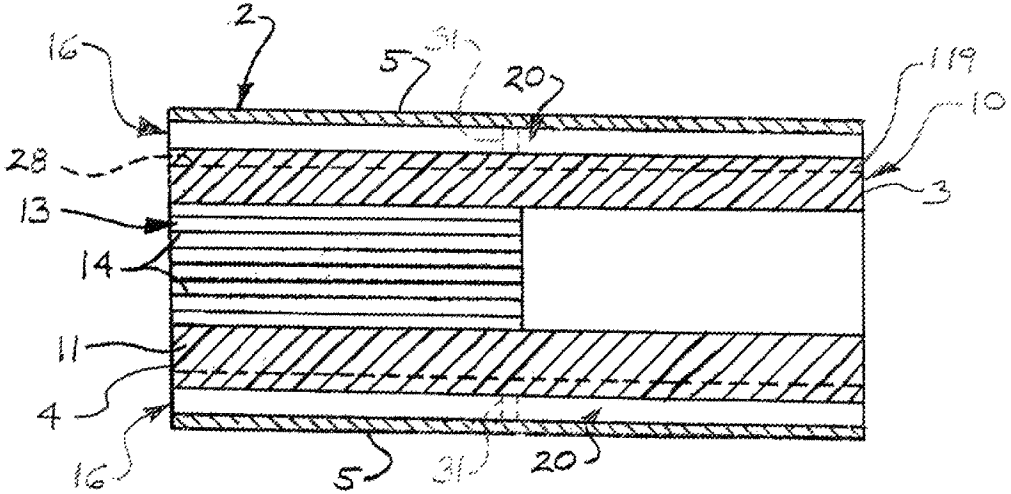
FIG. 6 is a longitudinal sectional view, taken along section lines 6-6 in FIG. 3, of the illustrative shearable drive assembly.

As illustrated in FIGS. 3 and 6, a shaft bore 13 may be formed by the core wall 11 from the fore sleeve end 3 to the aft sleeve end 4 of the drive sleeve 2. Shaft bore splines 14 may extend from the core wall 11 into the shaft bore 13. The shaft bore splines 14 may extend at least a portion of the length of the shaft bore 13.

At least one, and typically, multiple drive ribs 16 may extend from the exterior surface of the core wall 11. In some embodiments, four drive ribs 16 may extend from the core wall 11 in off-center, equally spaced or unequally spaced-apart relationship to each other, as illustrated. Accordingly, as illustrated in FIGS. 2 and 3, each drive rib 16 may correspond positionally with and may be centered with respect to a corresponding exterior sleeve lug 5 of the drive sleeve 2. The drive ribs 16 may be disposed in equally spaced relationship to each other. The drive ribs 16 may insert into the respective rib slots 7 in the interior surface of the drive sleeve 2. Each drive rib 16 may form an integral monolithic part with the core wall 11 of the drive core 10.

Each drive rib 16 may have any longitudinal trajectory as it extends along the length of the drive core 10 from the fore sleeve end 3 to the aft sleeve end 4. For example and without limitation, in various embodiments, the drive ribs 16 may be straight, angled, helical or any combination thereof. The longitudinal trajectories of the rib slots 7 in the drive sleeve 2 may correspond to the longitudinal trajectories of the respective corresponding drive ribs 16 on the drive core 10 to ensure optimal driving engagement between the drive sleeve 2 and the drive core 10 in the assembled shearable drive assembly 1.

Figure 4:
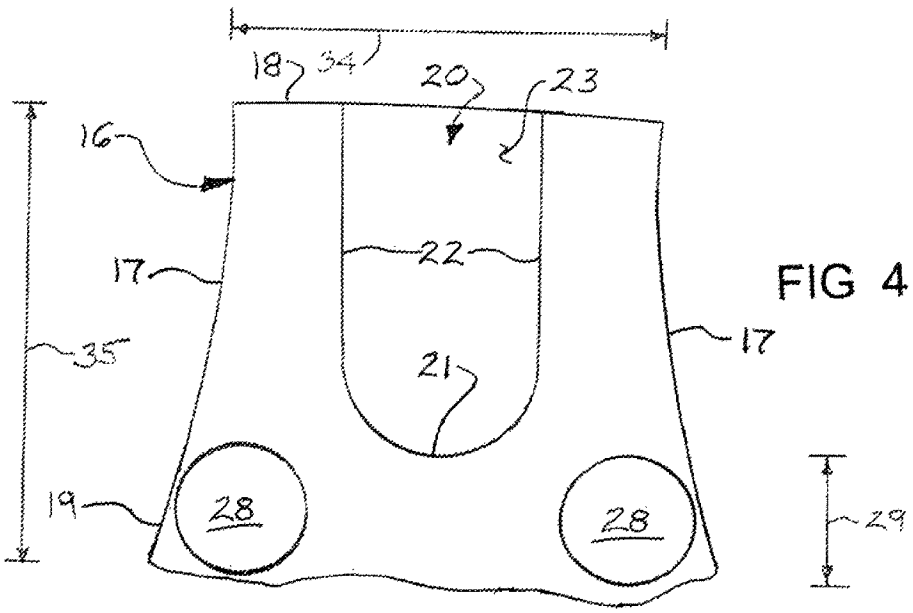
FIG. 4 is an enlarged sectional view, taken along section line 4 in FIG. 3, of a typical drive rib on a drive core of the shearable drive assembly, with a U-shaped shear cavity extending into the drive rib and a pair of rib shear channels at the respective sides of the rib base at the junction between the drive rib and a core wall of the drive core.

As illustrated in FIG. 4, each drive rib 16 of the drive core 10 may have a pair of side rib surfaces 17. An outer rib surface 18 may extend between the side rib surfaces 17. A rib base 19 may extend from the side rib surfaces 17. The rib base 19 may form the junction between the drive rib 16 and the core wall 11 of the drive core 10.

In some embodiments, the rib base 19 may have a curved or concave profile as it transitions from the side rib surfaces 17 to the core wall 11 of the drive core 10. In other embodiments, the rib base 19 may have a sharp or squared-off profile between the side rib surfaces 17 to the core wall 11. In still other embodiments, the rib base 19 may have a convex profile. As illustrated in FIG. 3, each interior rib slot 7 in the assembly sleeve 2 may be suitably sized and configured such that the exterior side rib surfaces 17, the outer rib surface 18 and the rib base 19 of each corresponding drive rib 16 inserted therein may engage the respective interior surfaces of the rib slot 7.

As further illustrated in FIG. 4, each drive rib 16 may have a rib width 34 as measured between the side rib surfaces 17 at the outer rib surface 18 and a rib height 35 as measured from the outer rib surface 18 to the rib base 19. The rib width 34 and the rib height 35, as well as the proportions therebetween, may be varied within each drive rib 16 or between drive ribs 16 on the drive core 10 of the same shearable drive assembly 1 to correspondingly select and vary the shear characteristics of each drive rib 16 and the shearable drive assembly 1.

At least one shear cavity 20 may extend into or through at least one drive rib 16 on the drive core 10. Each shear cavity 20 may alter the shear resistance characteristics of one or more of the drive ribs 16 in application of torsional forces from the propeller drive shaft 45 to the propeller hub 42 of the marine propeller 40 via the drive core 10 and the drive sleeve 2, respectively, of the shearable drive assembly 1.

Each shear cavity 20 may have any desired cross-sectional shape to impart the desired shear resistance characteristics or properties to each drive rib 16. For example and without limitation, as illustrated in FIG. 4 and will be hereinafter further described, each shear cavity 20 may have a U-shaped cross-section and extend into the outer rib surface 18 of the drive rib 16. Each shear cavity 20 may include an inner cavity surface 21. A pair of side cavity surfaces 22 may extend from the outer rib surface 18 to the inner cavity surface 21. In other embodiments, each shear cavity 20 may include a closed hole or channel which extends into or through the drive rib 16 along at least a portion of the length of the drive rib 16.

In some embodiments, each shear cavity 20 may be open or unenclosed. As used herein, "unenclosed" means that the shear cavity 20 opens to at least one of the outer rib surface 18 and one of the side rib surfaces 17 of the drive rib 16. For example and without limitation, as illustrated in FIG. 4, in some embodiments, the shear cavity 20 may open to the outer rib surface 18 of the drive rib 16. In some embodiments, the shear cavity 20 may additionally or alternatively open to one or both of the side rib surfaces 17. As will be hereinafter described, in some embodiments, one or more of the shear cavities 20 in each drive rib 16 may be enclosed such that the shear cavity 20 is entirely enclosed within the drive rib 16 and does not open to the outer rib surface 18 and/or one or both of the side rib surfaces 17. In some embodiments, each drive rib 16 may have a combination of at least one enclosed shear cavity 20 and at least one unenclosed shear cavity 20 to achieve the desired shear capability characteristics of each drive rib 16.

The exterior surface of the drive sleeve 2, the shear cavity 20 in each drive rib 16 and the drive core 10, as well as the propeller hub drive sleeve 48 of the propeller hub 42 on the marine propeller 40, may be straight, tapered, or any combination thereof from the fore sleeve end 3 to the aft sleeve end 4. In embodiments in which these features are tapered, the taper angles of the features may match one another, or may be dissimilar while working in a complementary manner. For example and without limitation, in some embodiments, the exterior surface of the drive sleeve 2 may have a greater taper angle than the interior surface of the propeller hub drive sleeve 48 of the propeller hub 42 such that the drive sleeve 2 imparts a greater force on the forward portion of the propeller hub drive sleeve 48, where the bearing surface has the greatest surface area.

The various dimensional, profile and other parameters and characteristics of each shear cavity 20 may increase, reduce, attenuate or vary the shear resistance characteristics or properties of one or more of the drive ribs 16 in application of the shearable drive assembly 1. The various shear resistance characteristics of the drive ribs 16 may cause the drive ribs 16 to shear or slip at different levels of torque and rotational limits. For example and without limitation, as illustrated in FIG. 6, the shear cavity 20 in each drive rib 16 may extend at least a portion of the length of the drive core 10 from the fore sleeve end 3 to the aft sleeve end 4 of the drive sleeve 2. In some embodiments, the shear cavity 20 may be continuous along its length and may extend the entire length of the drive core 10, typically opening to the ends of the drive rib 16 which correspond to the fore sleeve end 3 and the aft sleeve end 4 of the drive sleeve 2, as illustrated. In other embodiments, the shear cavity 20 may extend along less than half, half or more than half the distance between the fore sleeve end 3 and the aft sleeve end 4. In still other embodiments, the shear cavity 20 may be intermittent along its length with multiple shear cavity segments which extend in a sequential linear pattern from the fore sleeve end 3 to the aft sleeve end 4. A segment partition 31 (illustrated in phantom in FIG. 6) may separate linearly adjacent shear cavity segments from each other along the length of the drive core 10.

Figure 5:
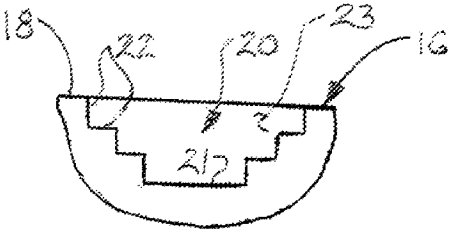
FIG. 5 is an enlarged sectional view of an alternative, stepped configuration of the shear cavity in the drive rib.

As illustrated in FIG. 4, in some embodiments, the shear cavity 20 may have a U-shaped configuration or profile in end view or cross-section. Accordingly, the side cavity surfaces 22 of each shear cavity 20 may extend in parallel, spaced-apart relationship to each other. The inner cavity surface 21 may be curved or concave as it extends between the side cavity surfaces 22. In other embodiments, the inner cavity surface 21 and the side cavity surfaces 22 of each shear cavity 20 may have alternative shapes or profiles. For example and without limitation, in some embodiments, the inner cavity surface 21 may be flat or planar or may be convex or multi-faceted. For example and without limitation, as illustrated in FIG. 5, in some embodiments, the inner cavity surface 21 of each shear cavity 20 may be flat or planar. The side cavity surfaces 22 may have a stepped or faceted profile as they extend from the outer rib surface 18 to the inner cavity surface 21. In alternative embodiments, the shear cavity 20 may have a V-shaped or other profile.

Figure 9:
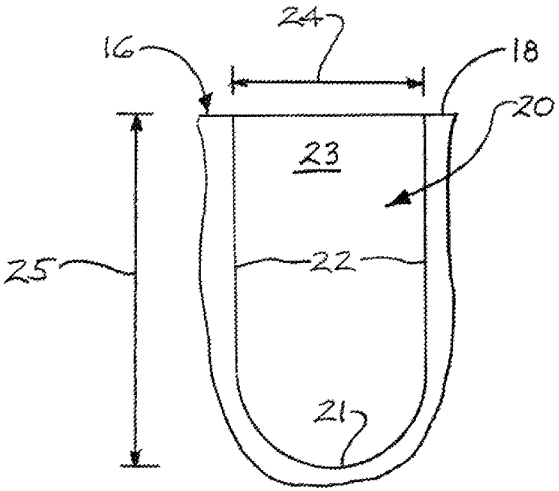
FIG. 9 is an enlarged end view of the typical U-shaped shear cavity in the drive rib.

As illustrated in FIG. 9, the shear cavity 20 in each drive rib 16 may have a cavity width 24 and a cavity depth 25. The cavity width 24 may correspond to the distance between the side cavity surfaces 22 at the outer rib surface 18 of the drive rib 16. The cavity depth 25 may correspond to the depth of the shear cavity 20 from the outer rib surface 18 to the inner cavity surface 21. The cavity width 24 and the cavity depth 25 may vary relative to each other from one embodiment of the shearable drive assembly 1 to another or from one drive rib 16 to another on the drive core 10 of the same shearable drive assembly 1. For example and without limitation, as illustrated in FIGS. 4 and 9, in some embodiments, the shear cavity 20 may be relatively deep, with the cavity depth 25 greater than the cavity width 24. In other embodiments, the cavity depth 25 may be substantially the same as the cavity width 24. In still other embodiments, the shear cavity 20 may be relatively shallow with the cavity depth 25 less than the cavity width 24.

As further illustrated in FIGS. 4 and 9, at least one cavity material 23 may be provided in the shear cavity 20 of each drive rib 16. In some embodiments, the cavity material 23 may include air. In some embodiments, the cavity material 23 may include at least one or a combination of elastomeric materials such as rubber, plastic and/or composite materials, for example and without limitation. In some embodiments, the cavity material 23 may include at least one or a combination of rigid or semirigid materials such as plastic, composites and/or metals, for example and without limitation. In some embodiments, elastomeric, rigid and/or semirigid materials may be combined in selected ratios and/or positions within each shear cavity 20 to achieve the desired shear capability or characteristics of each drive rib 16.

As further illustrated in FIGS. 2-4 and 6, in some embodiments, at least one rib shear channel 28 may extend into or through at least one drive rib 16 on the drive core 10 of the shearable drive assembly 1. The rib shear channel 28 may extend along at least a portion of the length of the drive core 10 from the fore sleeve end 3 to the aft sleeve end 4 of the drive sleeve 2. In some embodiments, each rib shear channel 28 may be intermittent along its length. In other embodiments, each rib shear channel 28 may be continuous along its length and may open to the ends of the drive rib 16 which correspond to the respective fore sleeve end 3 and aft sleeve end 4 of the drive sleeve 2.

In some embodiments, a rib shear channel 28 may be disposed at the rib base 19 on one or both sides of the drive rib 16, as illustrated in FIG. 4. In other embodiments, each rib shear channel 28 may be disposed at any location or position along and adjacent to the length of each corresponding side rib surface 17. In some embodiments, two or more rib shear channels 28 may be disposed at various locations or positions along or adjacent to the corresponding side rib surface 17. In some embodiments, at least one rib shear channel 28 may be disposed between the core wall 11 of the drive core 10 and the shear cavity 20 of the drive rib 16, as illustrated in FIG. 3.

Each rib shear channel 28 may have any desired size and cross-sectional shape or configuration. For example and without limitation, in some embodiments, each rib shear channel 28 may have a circular cross-section or end view profile, as illustrated in FIG. 4. In other embodiments, each rib shear channel 28 may have an oval, elliptical, triangular, square or other polygonal or non-polygonal cross-section or end view profile depending on the desired shear characteristics of the drive rib 16.

As illustrated in FIG. 4, each rib shear channel 28 may have a selected channel diameter or width 29. The channel diameter or width 29 of each rib shear channel 28 with respect to the overall rib width 34 and/or rib height 35 of the corresponding drive rib 16 and the cavity width 24 and/or cavity height 25 (FIG. 9) of the corresponding shear cavity 20, as well as the number and position or positions of the rib shear channels 28 and the shape and channel diameter or width 29 of each rib shear channel 28, may be selected to achieve the desired shear characteristics of each drive rib 16 and the overall desired shear characteristics of the shearable drive assembly 1.

As illustrated in FIG. 1, in typical application, the shearable drive assembly 1 may be inserted in the propeller hub 42 of the marine propeller 40. Accordingly, as illustrated in FIG. 2, the sleeve lugs 5 and the sleeve flats 6 on the exterior surface of the drive sleeve 2 may engage the companion lug slots 49 and hub drive sleeve flats 50, respectively, on the interior surface of the propeller hub drive sleeve 48. The propeller drive shaft 45 may be inserted typically initially through a thrust washer 84 and then through the shaft bore 13 in the drive core 10 of the drive sleeve 2 as the drive shaft splines 46 on the propeller drive shaft 45 mesh with the companion shaft bore splines 14 in the shaft bore 13 of the drive core 10.

A lock assembly 70 may be deployed to secure the marine propeller 40 on the propeller drive shaft 45. In some embodiments, the lock assembly 70 may include a lock adaptor 71 which is placed over the aft end of the propeller drive shaft 45. A tab washer 74 may engage the lock adaptor 71. A lock nut 78 may threadably engage drive shaft threads 47 on the aft end of the propeller drive shaft 45 and tightened against the tab washer 74.

In operation of the outboard motor on the marine vehicle, the shearable drive assembly 1 may transmit forward and reverse torsional forces from the propeller drive shall 45 to the marine propeller 40 through the drive core 10 and the drive sleeve 2 as the marine vehicle on which the outboard motor that drivingly engages the propeller drive shaft 45 is propelled on a water body. As illustrated in FIG. 2, as it rotates in the forward rotational direction 61, the marine propeller 40 propels the marine vehicle forwardly on the water body. As it rotates in the reverse rotational direction 62, the marine propeller 40 propels the marine vehicle in reverse on the water body.

Throughout operation of the marine vehicle, the drive core 10 transmits the torsional forces from the propeller drive shaft 45 to the drive sleeve 2 of the shearable drive assembly 1 via the drive ribs 16 on the drive core 10. The drive sleeve 2 transmits the torsional forces from the drive core 10 to the propeller hub drive sleeve 48 of the marine propeller 40 via engagement of the exterior sleeve lugs 5 and sleeve flats 6 on the drive sleeve 2 with the respective companion lug slots 49 and hub drive sleeve flats 50 on the interior surface of the propeller hub drive sleeve 48. The drive sleeve 2 may absorb vibration during gear changing. Additionally, the typically elastomeric construction of the drive sleeve 2 may eliminate or reduce deadband or "play" between the propeller 40 and the propeller drive shaft 45 upon termination of torque applied to the propeller drive shaft 45.

Figure 8:
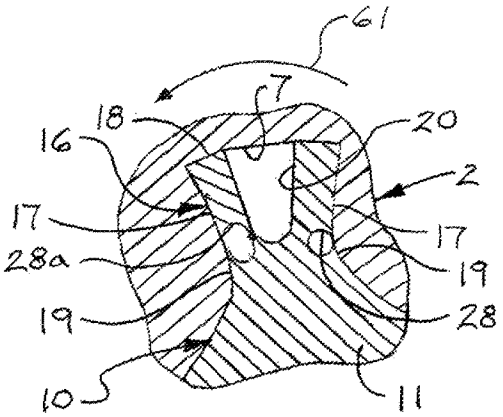
FIG. 8 is an enlarged sectional view of the drive rib, more particularly illustrating an alternative shear pattern of the drive rib at the rib shear channel.
Figure 7:
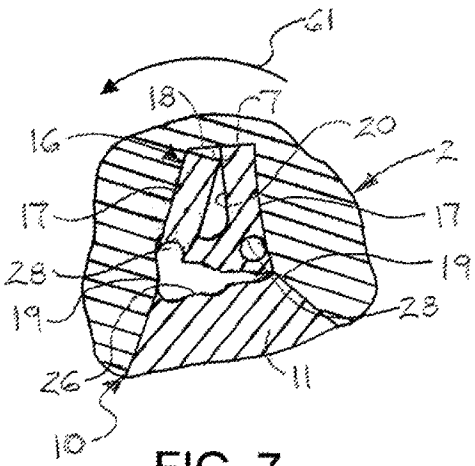
FIG. 7 is an enlarged sectional view of a drive rib, more particularly illustrating a typical shear pattern of the drive rib at one of the rib shear channels in the event that the marine propeller strikes a submerged obstacle (not illustrated) in typical application of the marine propellers with shearable drive assemblies.

The shear properties of the drive ribs 16 on the drive core 10 may impart shearing characteristics to the drive sleeve 2 for optimum driveline protection during propeller striking events, sudden gear changes and the like. In some applications in which the propeller blades 41 of the marine propeller 40 strike a submerged obstacle in the forward rotational direction 61 of the marine propeller 40, rotation of the marine propeller 40 may suddenly stop or substantially slow as the propeller drive shaft 45 continues to rotate at operational speed. Accordingly, one or more of the drive ribs 16 may partially or completely shear or shear at different rates, typically at the shear cavity 20 and/or one of the shear channels 28. For example and without limitation, as illustrated in FIG. 7, in some cases, a break line 26 may form at the leading rib shear channel 28 along the rib base 19, and the fractured portion of the drive rib 16 may break into the shear cavity 20. Alternatively, as illustrated in FIG. 8, the fractured portion of the drive rib 16 may break away from the shear cavity 20. The fractured drive rib or ribs 16 may thus absorb the strike force which may otherwise be borne by the propeller blades 41, other components of the marine propeller 40, the propeller drive shaft 45 and/or other components of the drivetrain, thus preventing or minimizing the likelihood of damaging these components. Engagement of the drive core 10 with the drive sleeve 2 at the fractured drive rib or ribs 16 may be attenuated or compromised. Typically, one or more of the drive ribs 16 may remain intact to continue rotational engagement between the propeller drive shaft 45 and the marine propeller 40 to ensure continued forward operation of the marine vehicle on the water body. The same effect may result in rotation of the marine propeller 40 in the reverse rotational direction 62, with the drive rib 16 typically fracturing at the trailing rib shear channel 28. In typical application, the drive ribs 16 may facilitate rotational absorption of about 5°-8° upon shearing of each.

Figure 10:
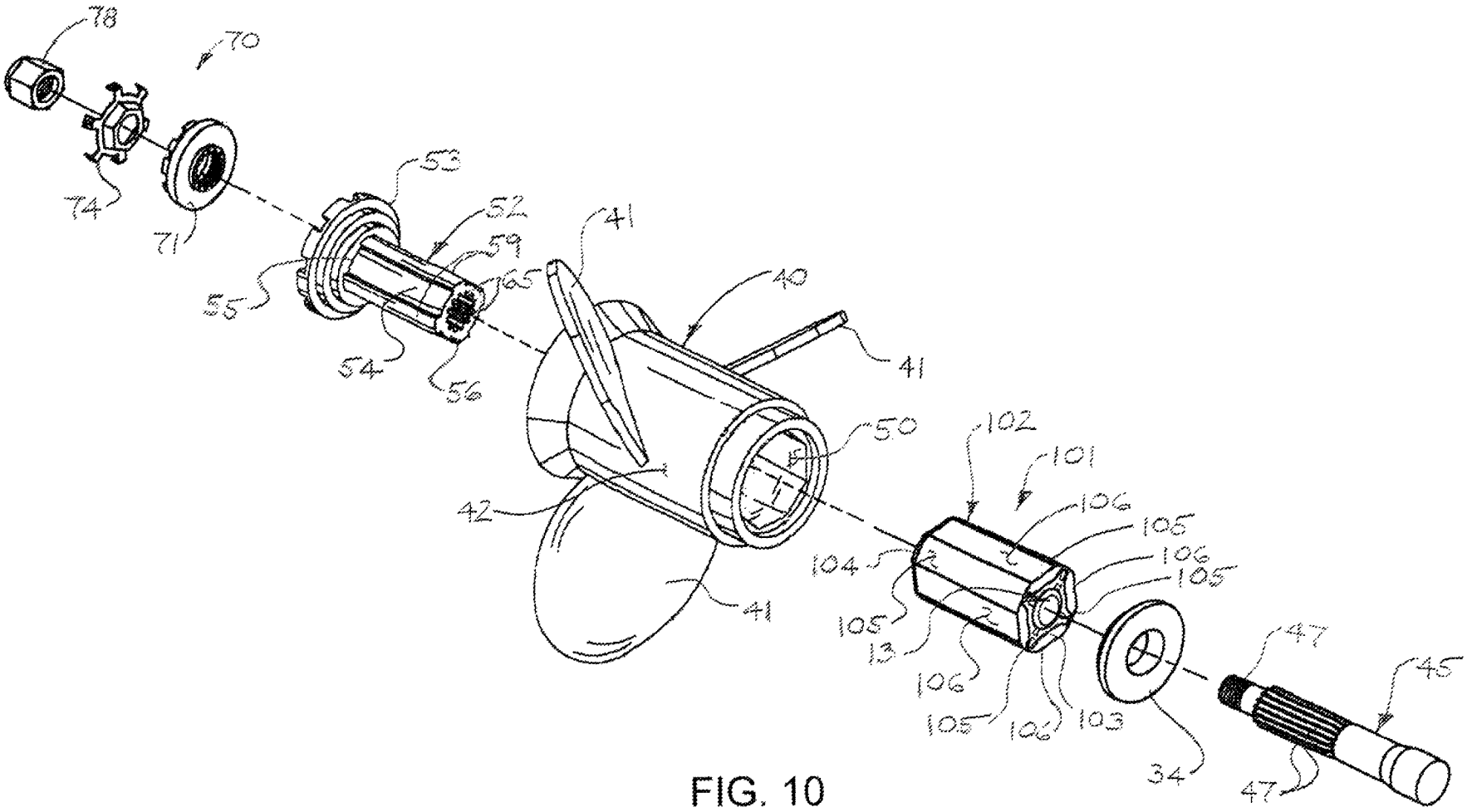
FIG. 10 is an exploded front perspective view of an alternative illustrative embodiment of the marine propellers with shearable drive assemblies with the shearable drive assembly in a disassembled state and removed from the marine propeller.
Figure 11:
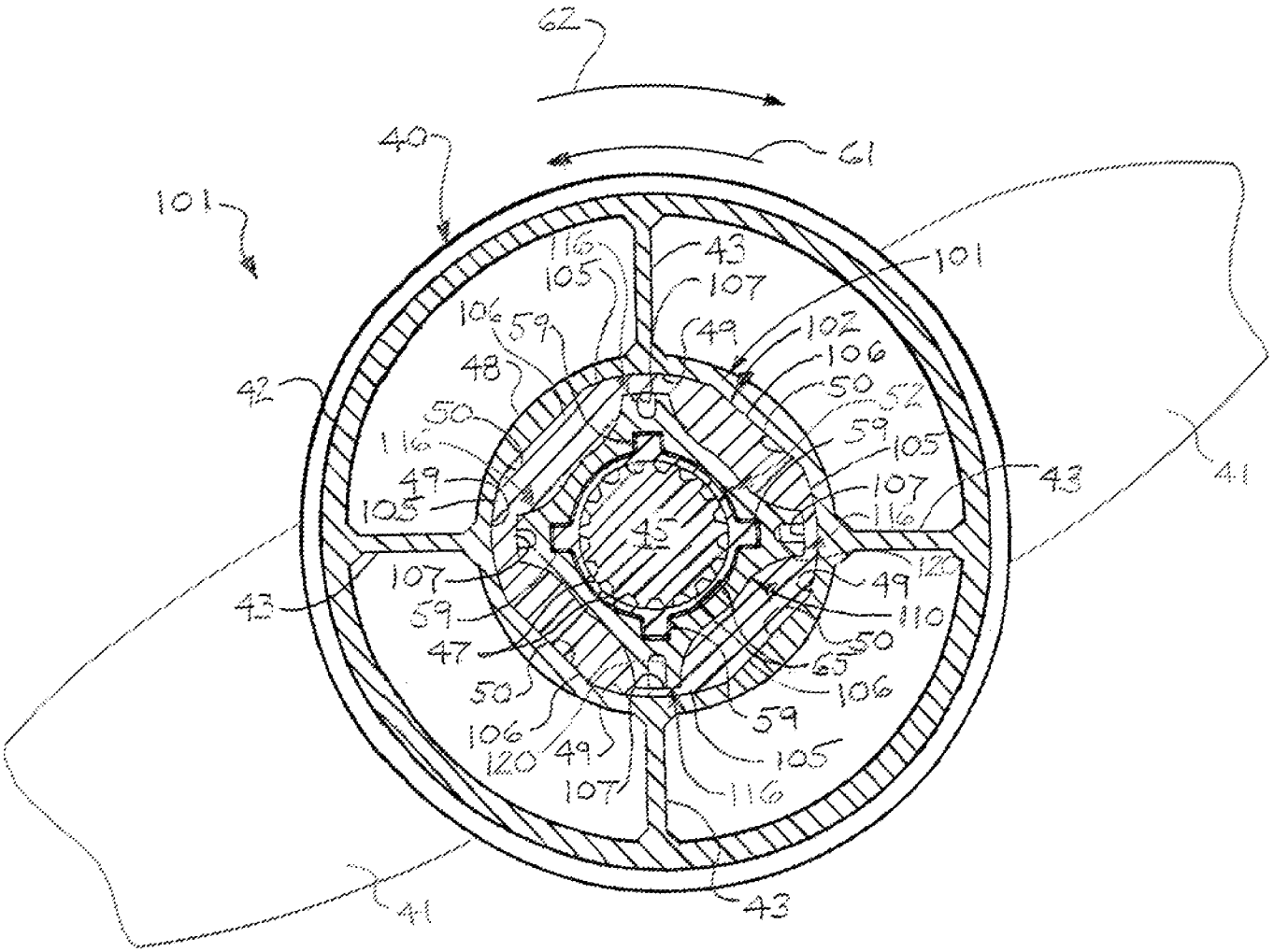
FIG. 11 is a cross-sectional view of the propeller hub of the assembled marine propeller illustrated in FIG. 10 and the illustrative shearable drive assembly deployed in place in the propeller hub.
Figure 12:
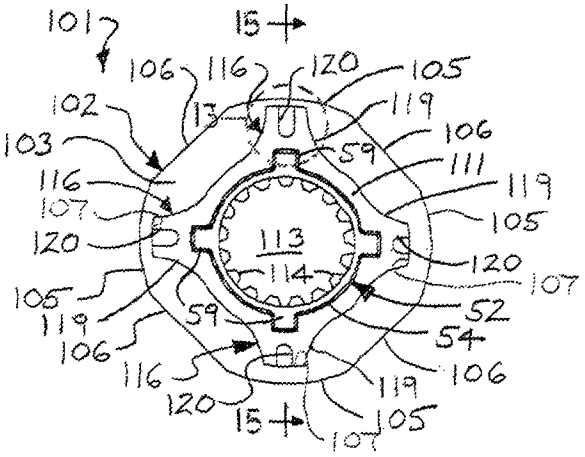
FIG. 12 is a fore end view of the illustrative shearable drive assembly illustrated in FIG. 11.
Figure 15:
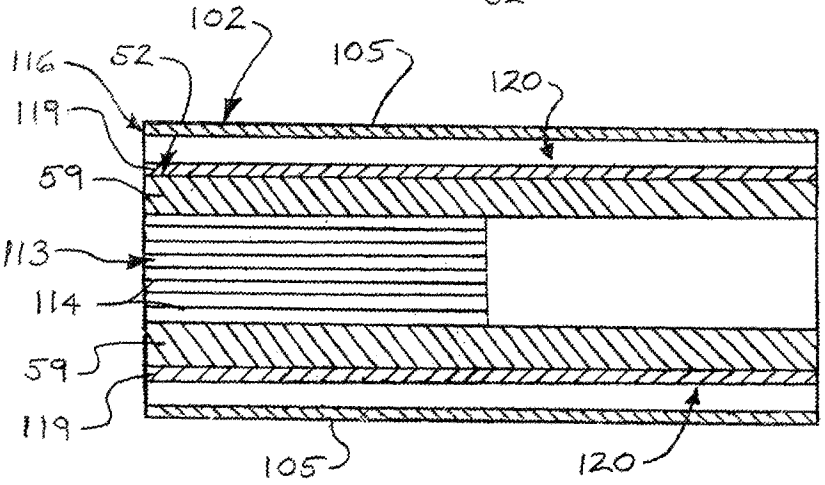
FIG. 15 is a longitudinal sectional view, taken along section lines 15-15 in FIG. 12, of the shearable drive assembly.
Figure 14:
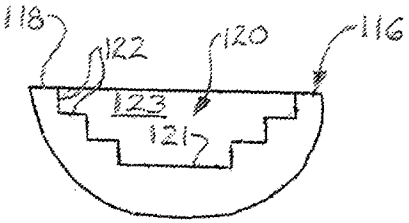
FIG. 14 is an enlarged sectional view of an alternative, stepped configuration of the shear cavity in the drive rib.

Referring next to FIGS. 10-15 of the drawings, an alternative illustrative embodiment of the shearable drive assemblies is generally indicated by reference numeral 101. In the shearable drive assembly 101, elements which are analogous to the respective elements of the shearable drive assembly 1 that was heretofore described with respect to FIGS. 1-9 are designated by the same respective numerals in the 101-199 series in FIGS. 10-15. As illustrated in FIGS. 10-12, the shearable drive assembly 101 may be suitably configured to be drivingly engaged by a drive adaptor 52 which is drivingly engaged for rotation by the propeller drive shaft 45. The drive adaptor 52 may include an adaptor base 53. An elongated adaptor shaft 54 may extend from the adaptor base 53. The adaptor shaft 54 may have an aft shaft end 55 at the adaptor base 53 and a fore shaft end 56 opposite the aft shaft end 55.

Adaptor drive splines 65 may be provided in the interior of the adaptor shaft 54 of the drive adaptor 52. As illustrated in FIG. 11, in assembly of the marine propeller 40 on the propeller drive shaft 45, the interior adaptor drive splines 65 may mesh with the companion exterior drive shaft splines 46 on the propeller drive shaft 45. At least one, and typically, multiple adaptor lugs 59 may extend from and along the adaptor shaft 54.

Figure 13:
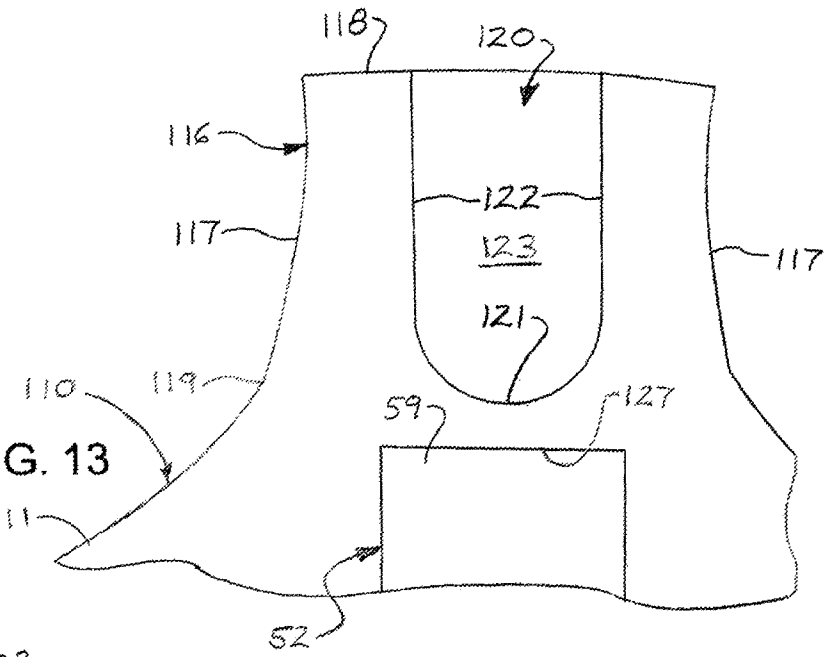
FIG. 13 is an enlarged sectional view, taken along section line 13 in FIG. 12, of a typical drive rib on the drive core of the illustrative shearable drive assembly, with a typical U-shaped shear cavity extending into the drive rib and an adaptor lug on a drive adaptor extending into a lug cavity in the drive core.

As illustrated in FIG. 13, at least one, and typically, multiple lug cavities 127 may be provided in the core wall 111 of the drive core 110. Each lug cavity 127 may be suitably sized and configured to receive a corresponding adaptor lug 59 on the adaptor shaft 54 of the drive adaptor 52.

Application of the shearable drive assembly 101 may be as was heretofore described with respect to the shearable drive assembly 1 in FIGS. 1-9. In rotation of the propeller drive shaft 45 in the forward rotational direction 61 (FIG.

11), the drive adaptor 52 transmits the forward torsional force from the propeller drive shaft 45 to the drive core 110 via the adaptor lugs 59. The drive core 110, in turn, transmits the torsional force to the drive sleeve 102 via the drive ribs 116, and the drive sleeve 102 transmits the torsional force to the propeller hub drive sleeve 48 typically via the sleeve lugs 105 and the sleeve flats 106. As the shearable drive assembly 101 transfers the torsional drive force from the propeller drive shaft 45 to the propeller hub 42, the shearing characteristics of the drive ribs 116 may impart shear capability between those components to prevent or minimize damage to the propeller drive system during power surges, sudden gear changes and loads typically in the event that one of the propeller blades 41 of the rotating propeller 40 inadvertently strikes a submerged object (not illustrated), typically as was heretofore described with respect to the shearable drive assembly 1 in FIGS. 1-9.

Figure 16:
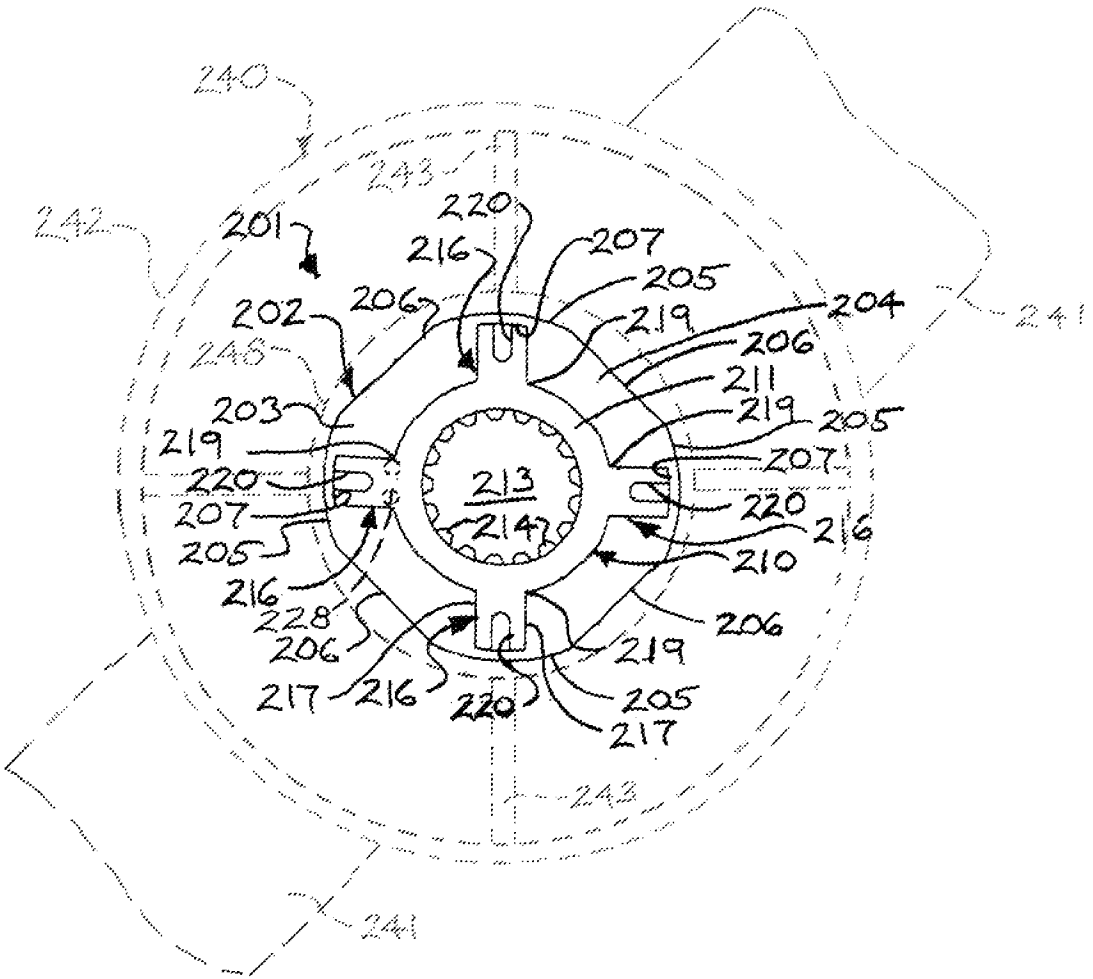
FIG. 16 is a fore end view of an alternative illustrative marine propeller with shearable drive assembly having sharp concave corners at the rib base of each drive rib, with the marine propeller shown in phantom lines and the shearable drive assembly shown in solid lines.

Referring next to FIG. 16 of the drawings, an alternative illustrative embodiment of the marine propellers with shearable drive assemblies is generally indicated by reference numeral 240. In the shearable drive assembly 201 of the marine propeller 240, elements analogous to the respective elements of the marine propeller 40 having the shearable drive assembly 1 that was heretofore described with respect to FIGS. 1-9 are designated by the same respective numerals in the 201-299 series in FIG. 16. The rib base 219 of each drive rib 216 may have sharp concave corners which extend longitudinally along the length of the drive core 10 at the respective side rib surfaces 217 of each drive rib 216.

Application of the marine propeller 240 with the shearable drive assembly 201 may be as was heretofore described with respect to the marine propeller 1 with the shearable drive assembly 1 in FIGS. 1-9. Accordingly, in the event that the propeller blades 41 of the marine propeller 40 strike a submerged obstacle in the water body, the drive ribs 216 may readily fracture or break at the rib base 219, thereby absorbing the strike force which may otherwise be borne by the propeller blades 41 and/or other components of the marine propeller 40, the propeller drive shaft 45 and/or other components of the drivetrain. In some embodiments, at least one rib shear channel 228 (illustrated in phantom) may extend along at least one drive rib 216 to further attenuate the shear capability of the drive rib or ribs 216.

Figure 17:
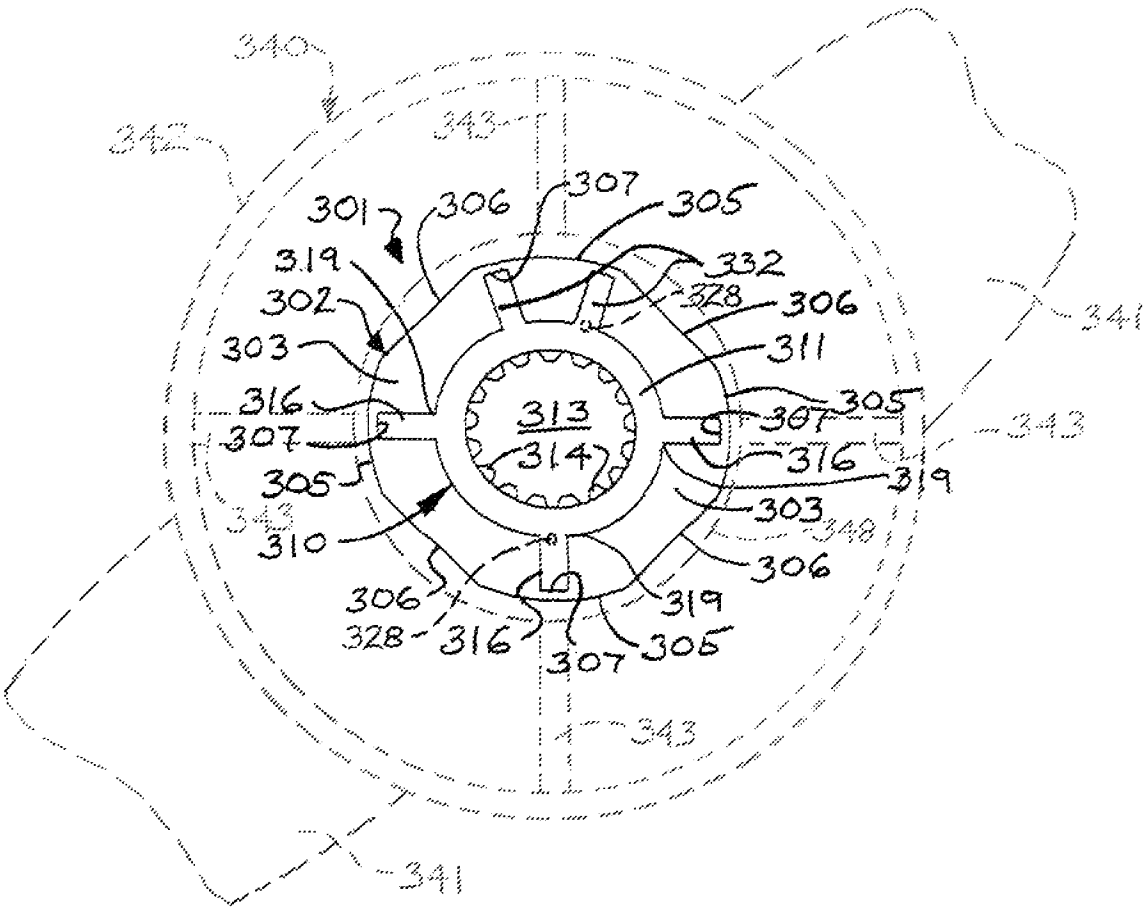
FIG. 17 is a fore end view of another alternative illustrative marine propeller with shearable drive assembly having a pair of offset sacrificial ribs extending from the core wall of the drive core, with the marine propeller shown in phantom lines and the shearable drive assembly shown in solid lines.

Referring next to FIG. 17 of the drawings, an alternative illustrative embodiment of the marine propellers with shearable drive assemblies is generally indicated by reference numeral 340. In the shearable drive assembly 301 of the marine propeller 340, elements analogous to the respective elements of the marine propeller 40 shearable drive assembly 1 that was heretofore described with respect to FIGS. 1-9 are designated by the same respective numerals in the 301-399 series in FIG. 17. At least one sacrificial rib 332 may extend from the core wall 311 of the drive core 310. In some embodiments, a pair of sacrificial ribs 332 may extend from the core wall 311 in spaced-apart relationship to each other, as illustrated. The sacrificial ribs 332 may angle away from each other, as illustrated. The sacrificial ribs 332 may correspond positionally to a sleeve lug 305 of the drive sleeve 302, with the remaining drive ribs 316 typically corresponding positionally to the remaining sleeve lugs 305.

Application of the marine propeller 340 with the shearable drive assembly 301 may be as was heretofore described with respect to the shearable drive assembly 1 in FIGS. 1-9. Accordingly, the drive ribs 316 and the sacrificial ribs 332 may transmit the forward and reverse torsional forces from the drive core 310 to the drive sleeve 302 of the shearable drive assembly 301. The sacrificial ribs 332 may impart offset rotational bias to the drive sleeve 302 for longer rotational movement in the forward rotational direction 61 or the rearward rotational direction 62 (FIG. 11), respectively. Therefore, in the event that the propeller blades 41 of the marine propeller 40 strike a submerged obstacle in a water body, the sacrificial ribs 332 may fracture or break at the core wall 311 more readily than the drive ribs 316, thereby absorbing the strike force which may otherwise be borne by the propeller blades 41 and/or other components of the marine propeller 40, the propeller drive shaft 45 and/or other components of the drivetrain. In some embodiments, at least one shear cavity 20 (FIG. 4) and/or at least one rib shear channel 328 (illustrated in phantom) may extend within or along each drive rib 316 and/or each sacrificial rib 332 to further attenuate the shear capability of the drive rib 316.

Figure 18:
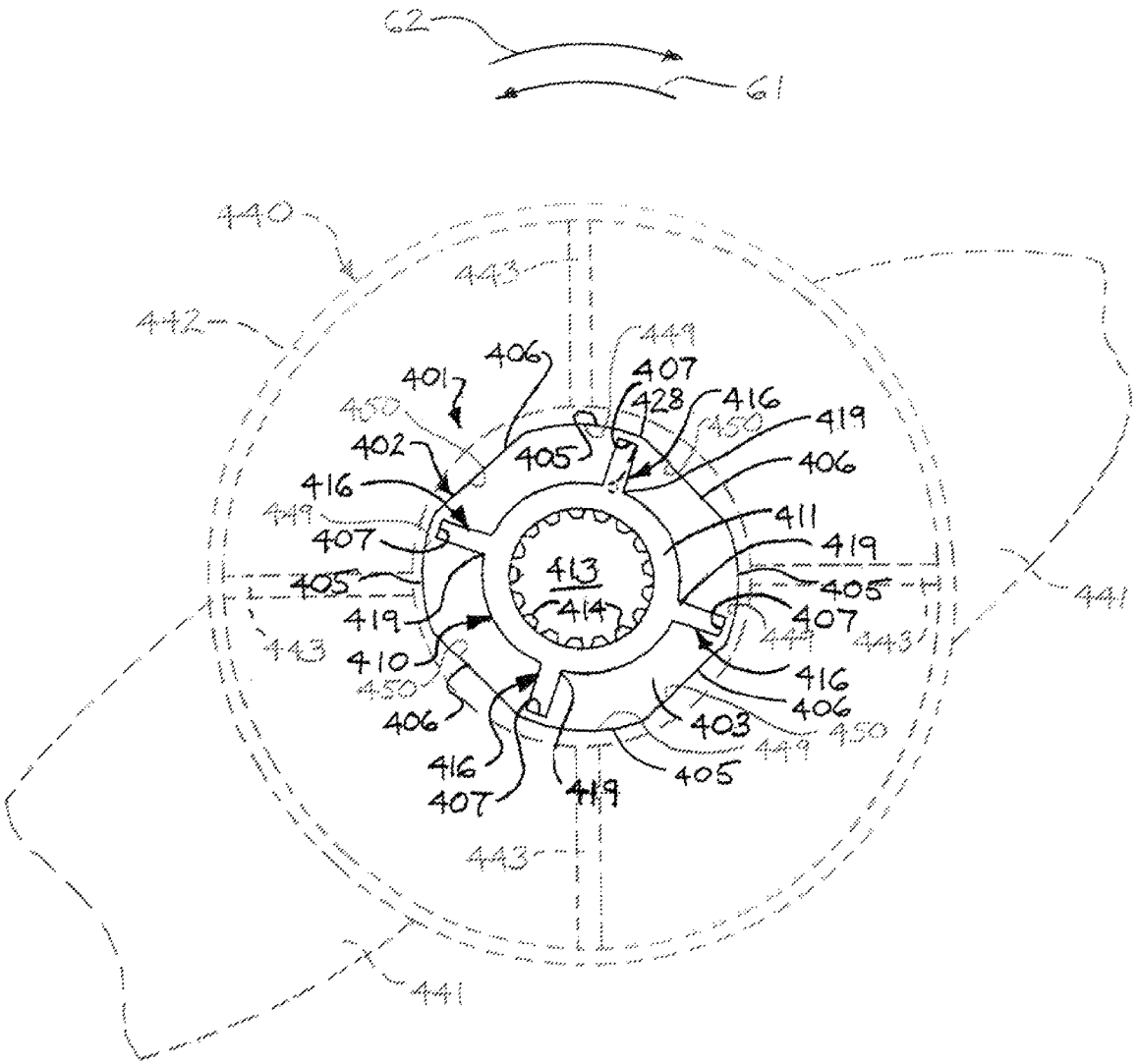
FIG. 18 is a fore end view of still another alternative illustrative marine propeller with shearable drive assembly having a drive core with drive ribs offset with respect to the drive sleeve of the assembly, with the marine propeller shown in phantom lines and the shearable drive assembly shown in solid lines.

Referring next to FIG. 18 of the drawings, another alternative illustrative embodiment of the marine propellers with shearable drive assemblies is generally indicated by reference numeral 440. In the shearable drive assembly 401 of the marine propeller 440, elements analogous to the analogous to the respective elements of the shearable drive assembly 1 that was heretofore described with respect to FIGS. 1-9 are designated by the same respective numerals in the 401-499 series in FIG. 18. The drive core 410 may be circumferentially offset with respect to the drive sleeve 402 of the shearable drive assembly 401. Accordingly, each drive rib 416 may correspond positionally to a corresponding sleeve lug 405 of the drive sleeve 402, with the drive rib 416 off-center with respect to the sleeve lug 405 away from the forward rotational direction 61, as illustrated (for forward rotational bias), or toward the reverse rotational direction 62 (for rearward rotational bias).

Application of the marine propeller 440 with the shearable drive assembly 401 may be as was heretofore described with respect to the shearable drive assembly 1 in FIGS. 1-9. In the event that the propeller blades 41 of the marine propeller 40 strike a submerged obstacle in a water body, the offset configuration of the drive ribs 416 relative to the sleeve lugs 405 may impart offset rotational bias to the drive ribs 416 and non-equatorial loading of the drive ribs 416 for longer rotational movement of the drive ribs 416 in the forward rotational direction 61, as illustrated, or in the reverse rotational direction (in embodiments in which the drive ribs 416 are offset in the opposite direction). The longer rotational movement of the drive ribs 416 may delay or optimize fracture or breakage of the drive ribs 416 as the drive ribs 416 absorb the strike force which may otherwise be borne by the propeller blades 41 and/or other components of the marine propeller 40 and/or the propeller drive shaft 45 and/or other components of the drivetrain. In some embodiments, at least one shear cavity 20 (FIG. 4) and/or at least one rib shear channel 428 (illustrated in phantom) may extend within or along each drive rib 416 to further attenuate the shear capability of the drive rib 416.

Figure 19:
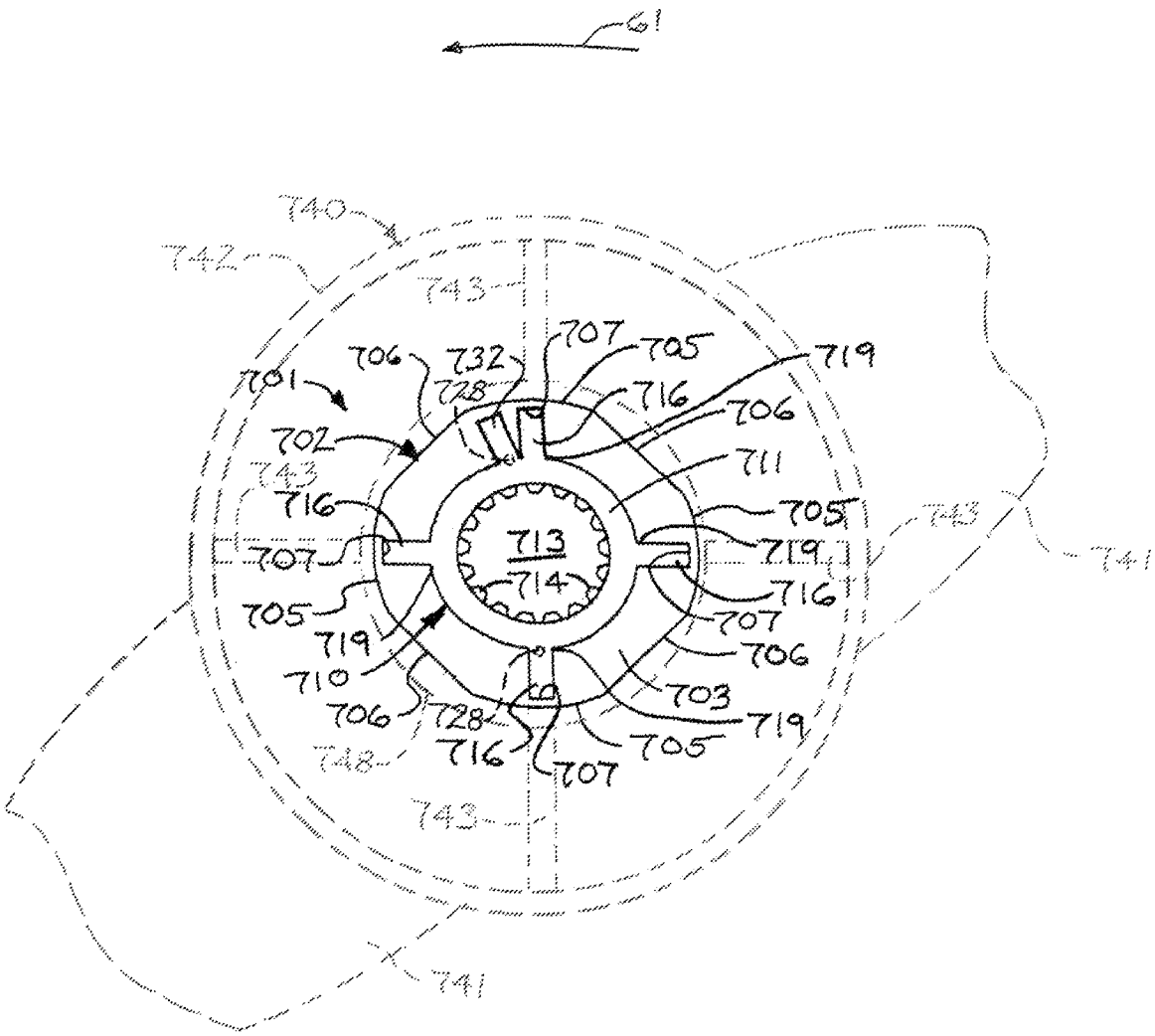
FIG. 19 is a fore end view of still another alternative illustrative marine propeller with shearable drive assembly having a drive core with an angled sacrificial rib immediately adjacent to a drive rib and extending in the forward rotational direction of the assembly, with the marine propeller shown in phantom lines and the shearable drive assembly shown in solid lines.
Figure 20:
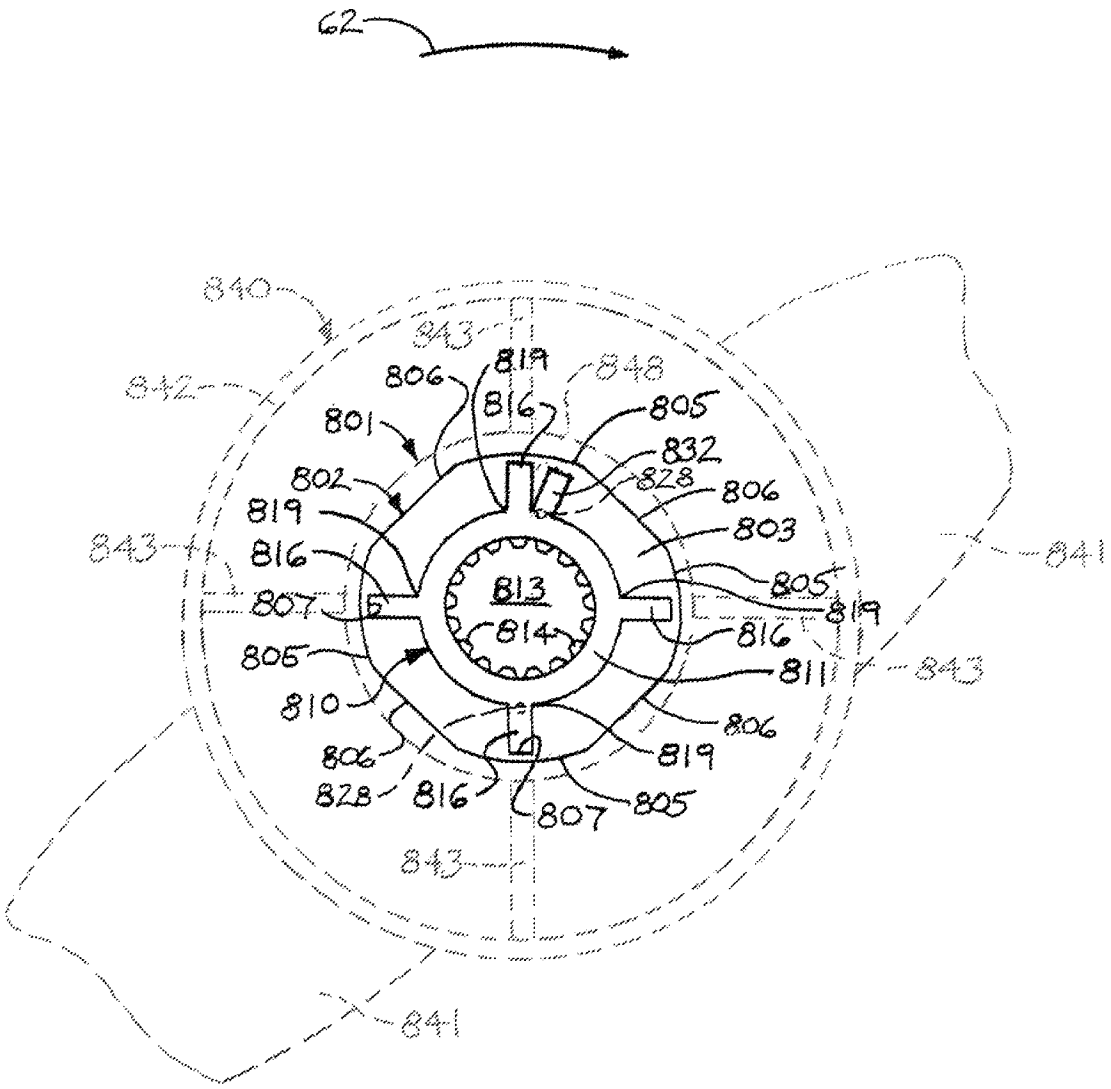
FIG. 20 is a fore end view of still another alternative illustrative marine propeller with shearable drive assembly having a drive core with an angled sacrificial rib immediately adjacent to a drive rib and extending in the reverse rotational direction of the assembly, with the marine propeller shown in phantom lines and the shearable drive assembly shown in solid lines.

Referring next to FIGS. 19 and 20 of the drawings, an alternative illustrative embodiment of the marine propellers with shearable drive assemblies having a shearable drive assembly 701 is generally indicated by reference numeral 740 in FIG. 19. An illustrative embodiment of the marine propellers with shearable drive assemblies having a shearable drive assembly 801 is generally indicated by reference numeral 840 in FIG. 20. Elements analogous to the respective elements of the shearable drive assembly 1 that was heretofore described with respect to FIGS. 1-9 are designated by the same respective numerals in the 701-799 series in FIG. 19 and in the 801-899 series in FIG. 20. As illustrated in FIG. 19, at least one sacrificial rib 732 may extend from the core wall 711 of the drive core 710, typically immediately adjacent to and angling away from at least one drive rib 716 in the forward rotational direction 61, as illustrated. The drive rib 716 and adjacent sacrificial rib 732 may correspond positionally to a sleeve lug 705 of the drive sleeve 702, with the remaining drive ribs 716 typically corresponding positionally to the remaining sleeve lugs 705, respectively.

Application of the marine propeller 740 with shearable drive assembly 701 may be as was heretofore described with respect to the marine propeller 40 with the shearable drive assembly 1 in FIGS. 1-9. Accordingly, the drive ribs 716 and the sacrificial rib 732 may transmit the torsional force from the drive core 710 to the drive sleeve 702 of the shearable drive assembly 701. In the event that the propeller blades 741 of the marine propeller 740 strike a submerged obstacle in a water body (in the forward rotational direction 61), the sacrificial rib 732 may fracture or break at the core wall 711 more readily than the drive ribs 716, thereby absorbing the strike force which may otherwise be borne by the propeller blades 741 and/or other components of the marine propeller 740, the propeller drive shaft 745 and/or other components of the drivetrain. In some embodiments, at least one shear cavity 20 (FIG. 4) and/or at least one rib shear channel 728 (illustrated in phantom) may extend within or along each drive rib 716 and/or the sacrificial rib 732 to further attenuate the shear capability of the drive rib 716 and/or sacrificial rib 732.

In the shearable drive assembly 801 illustrated in FIG. 20, the sacrificial rib 832 may angle away from the drive rib 816 in the reverse rotational direction 62. In the event that the propeller blades 841 of the marine propeller 840 strike a submerged obstacle in a water body in the rearward rotational direction 62, the sacrificial rib 832 may fracture or break at the core wall 811 more readily than the drive ribs 816, thereby absorbing the strike force.

Figure 21:
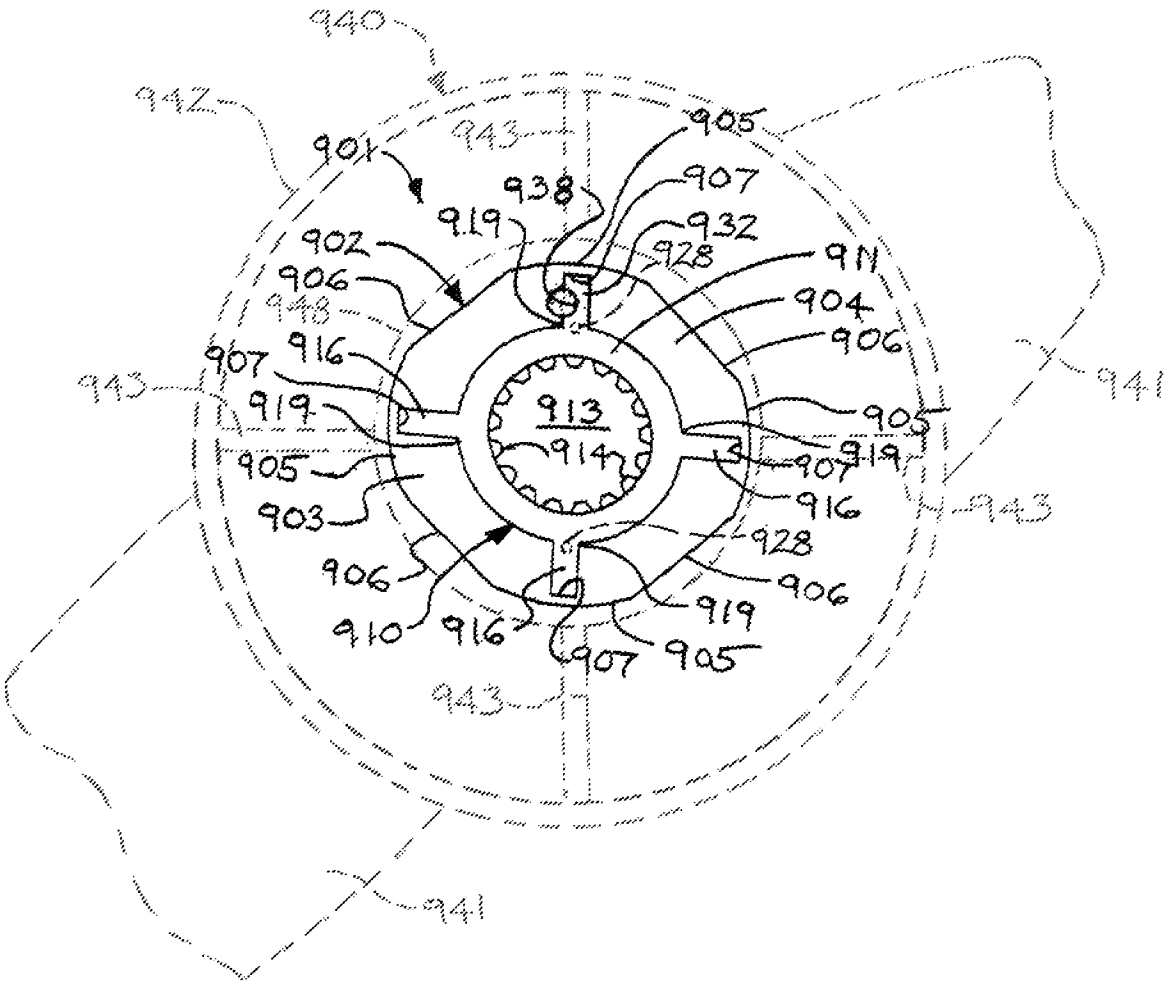
FIG. 21 is a fore end view of another alternative illustrative marine propeller with shearable drive assembly having an overlapping shear channel overlapping an interface between a sacrificial rib and the drive sleeve, with the marine propeller shown in phantom lines and the shearable drive assembly shown in solid lines.

Referring next to FIG. 21 of the drawings, another alternative illustrative embodiment of the marine propellers with shearable drive assemblies is generally indicated by reference numeral 940. In the shearable drive assembly 901 of the propeller 940, elements analogous to the analogous to the respective elements of the marine propeller 940 having the shearable drive assembly 1 that was heretofore described with respect to FIGS. 1-9 are designated by the same respective numerals in the 901-999 series in FIG. 21. The drive ribs 916 of the drive core 910 may correspond positionally to the respective sleeve lugs 905 on the drive sleeve 902.

At least one overlapping shear channel 938 may extend longitudinally within and along at least one sacrificial rib 932 in overlapping relationship to the drive sleeve 902. In some embodiments, the overlapping shear channel 938 may have a circular shape or profile in cross-section or end view, as illustrated. In other embodiments, the overlapping shear channel 938 may be oval. The longitudinal axis of the oval overlapping shear channel 938 may be oriented radially or transverse in the drive sleeve 902. In still other embodiments, the overlapping shear channel 938 may have alternative polygonal or non-polygonal shapes in cross-section or end view profile.

Application of the marine propeller 940 with the shearable drive assembly 901 may be as was heretofore described with respect to the shearable drive assembly 1 in FIGS. 1-9. Accordingly, the drive ribs 916 may transmit the torsional force from the drive core 910 to the drive sleeve 902 of the shearable drive assembly 901. In the event that the propeller blades 941 of the marine propeller 940 strike a submerged obstacle in a water body, the drive sleeve 902 and/or the sacrificial rib 932 may deform or fracture at the overlapping shear channel 938, thereby absorbing the strike force which may otherwise be borne by the propeller blades 941 and/or other components of the marine propeller 940, the propeller drive shaft 945 and/or other components of the drivetrain. In some embodiments, at least one shear cavity 20 and/or at least one rib shear channel 928 (illustrated in phantom) may extend along at least one drive rib 916 and/or sacrificial rib 932 to attenuate the shear capability of the drive rib or ribs 916 and/or sacrificial rib or ribs 932.

Figure 22:
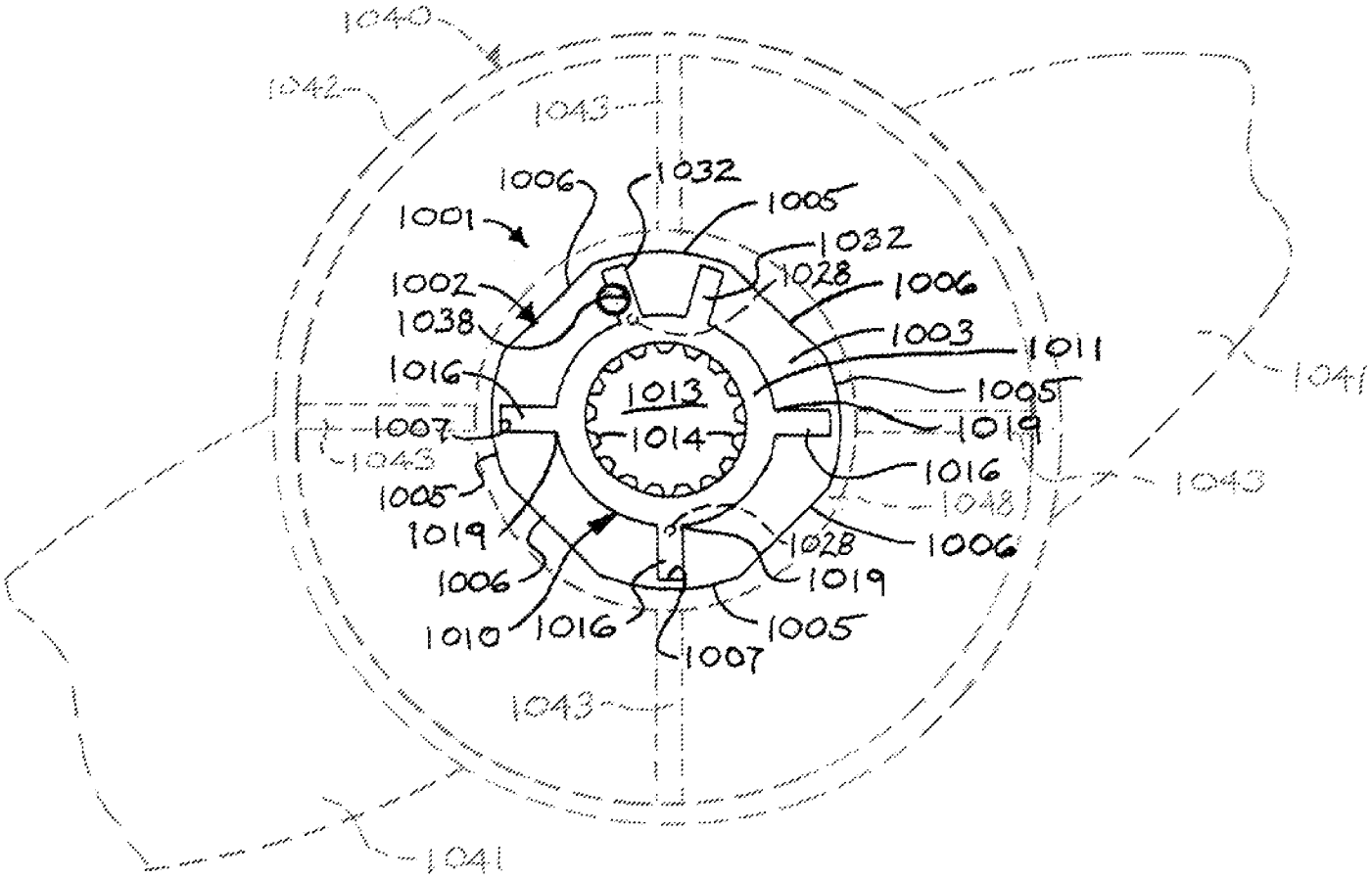
FIG. 22 is a fore end view of yet another alternative marine propeller with shearable drive assembly having an overlapping shear channel overlapping an interface between an offset sacrificial rib and the drive sleeve; with the marine propeller shown in phantom lines and the shearable drive assembly shown in solid lines.

Referring next to FIG. 22 of the drawings, another alternative illustrative embodiment of the marine propellers with shearable drive assemblies is generally indicated by reference numeral 1040. In the shearable drive assembly 1001 of the marine propeller 1040, elements analogous to the analogous to the respective elements of the shearable drive assembly 1 that was heretofore described with respect to FIGS. 1-9 are designated by the same respective numerals in the 1001-1099 series in FIG. 22. The drive ribs 1016 of the drive core 1010 may correspond positionally to the respective sleeve lugs 1005 on the drive sleeve 1002.

At least one sacrificial rib 1032 may extend from the core wall 1011 of the drive core 1010. In some embodiments, a pair of sacrificial ribs 1032 may extend from the core wall 1011 in spaced-apart relationship to each other, as illustrated. The sacrificial ribs 1032 may angle away from each other, as illustrated, and may correspond positionally to a sleeve lug 1005 of the drive sleeve 1002, with the remaining drive ribs 1016 typically corresponding positionally to the remaining sleeve lugs 1005, respectively.

At least one overlapping shear channel 1038 may extend longitudinally within and along at least one sacrificial rib 1032 in overlapping relationship to the drive sleeve 1002. In some embodiments, the overlapping shear channel 1038 may have a circular shape in cross-section or end view, as illustrated. In other embodiments, the overlapping shear channel 1038 may be oval. The longitudinal axis of the oval overlapping shear channel 1038 may be oriented radially or transverse in the drive sleeve 1002. In still other embodiments, the overlapping shear channel 1038 may have alternative polygonal or non-polygonal shapes in cross-section or end view.

Application of the shearable drive assembly 1001 may be as was heretofore described with respect to the shearable drive assembly 1 in FIGS. 1-9. Accordingly, the drive ribs 1016 and the sacrificial ribs 1032 may transmit the torsional force from the drive core 1010 to the drive sleeve 1002 of the shearable drive assembly 1001. In the event that the propeller blades 1041 of the marine propeller 1040 strike a submerged obstacle in a water body, the drive sleeve 1002 and/or the sacrificial ribs 1032 may deform or fracture at the overlapping shear channel 1038, thereby absorbing the strike force which may otherwise be borne by the propeller blades 1041 and/or other components of the marine propeller 1040, the propeller drive shaft 1045 and/or other components of the drivetrain. In some embodiments, at least one shear cavity 20 and/or at least one rib shear channel 1028 (illustrated in phantom) may extend within or along at least one drive rib 1016 and/or sacrificial rib 1032 to attenuate the shear capability of the drive rib or ribs 1016 and/or sacrificial rib or ribs 1032.

Figure 23:
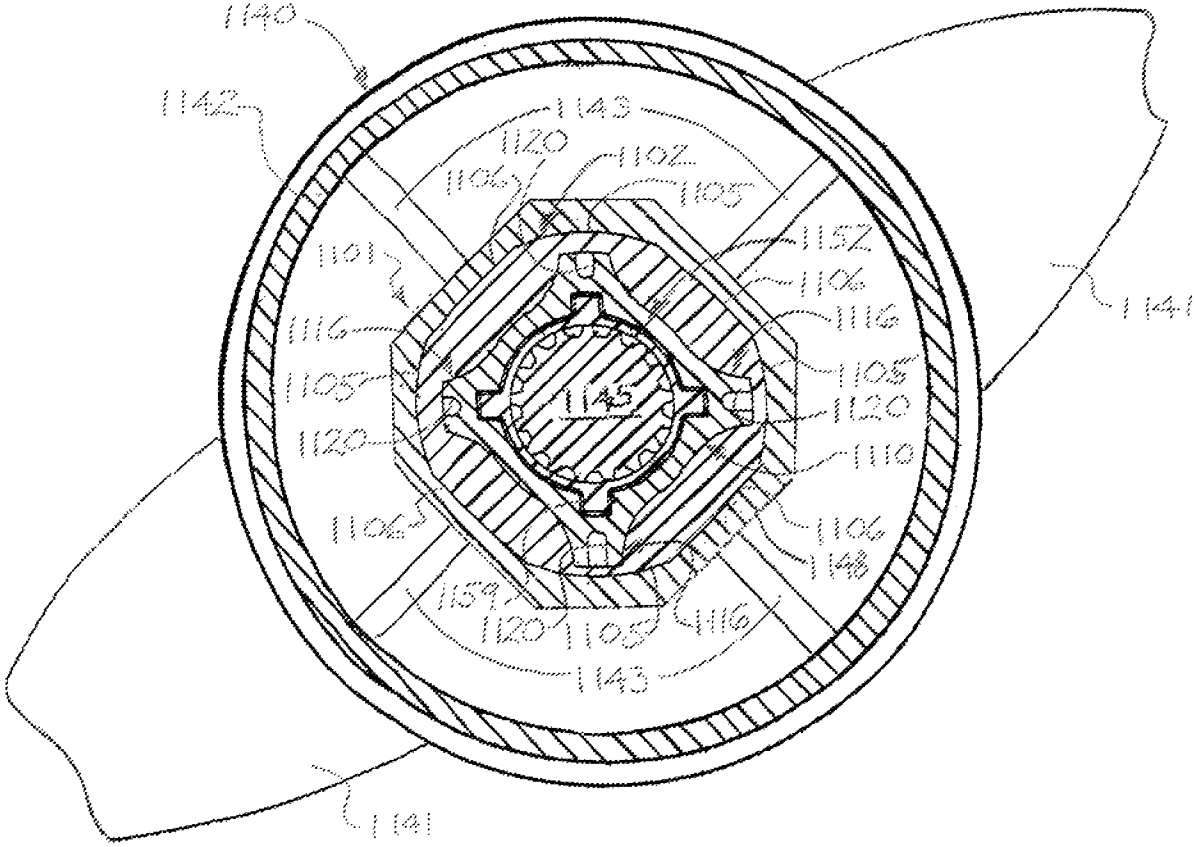
FIG. 23 is a cross-sectional view of another alternative marine propeller with shearable drive assembly having an octagonal propeller hub drive sleeve.

Referring next to FIG. 23 of the drawings, another alternative illustrative embodiment of the marine propellers with shearable drive assemblies is generally indicated by reference numeral 1140. In the shearable drive assembly 1101 of the marine propeller 1140, elements analogous to the respective elements of the shearable drive assembly 1 that was heretofore described with respect to FIGS. 1-9 are designated by the same respective numerals in the 1101-1199 series in FIG. 23. The propeller hub drive sleeve 1148 of the propeller hub 1142 may be polygonal, such as octagonal, for example and without limitation, with the hub vanes 1143 typically extending between the respective sleeve faces of the propeller hub drive sleeve 1148 and the propeller hub 1142. Application of the marine propeller 1140 with shearable drive assembly 1101 may be as was heretofore described with respect to the shearable drive assembly 1 in FIGS. 1-9. Accordingly, the drive ribs 1016 and the sacrificial ribs 1032 may transmit the torsional force from the drive core 1110 to the drive sleeve 1102 of the shearable drive assembly 1101.

Figures 24A, 24B:
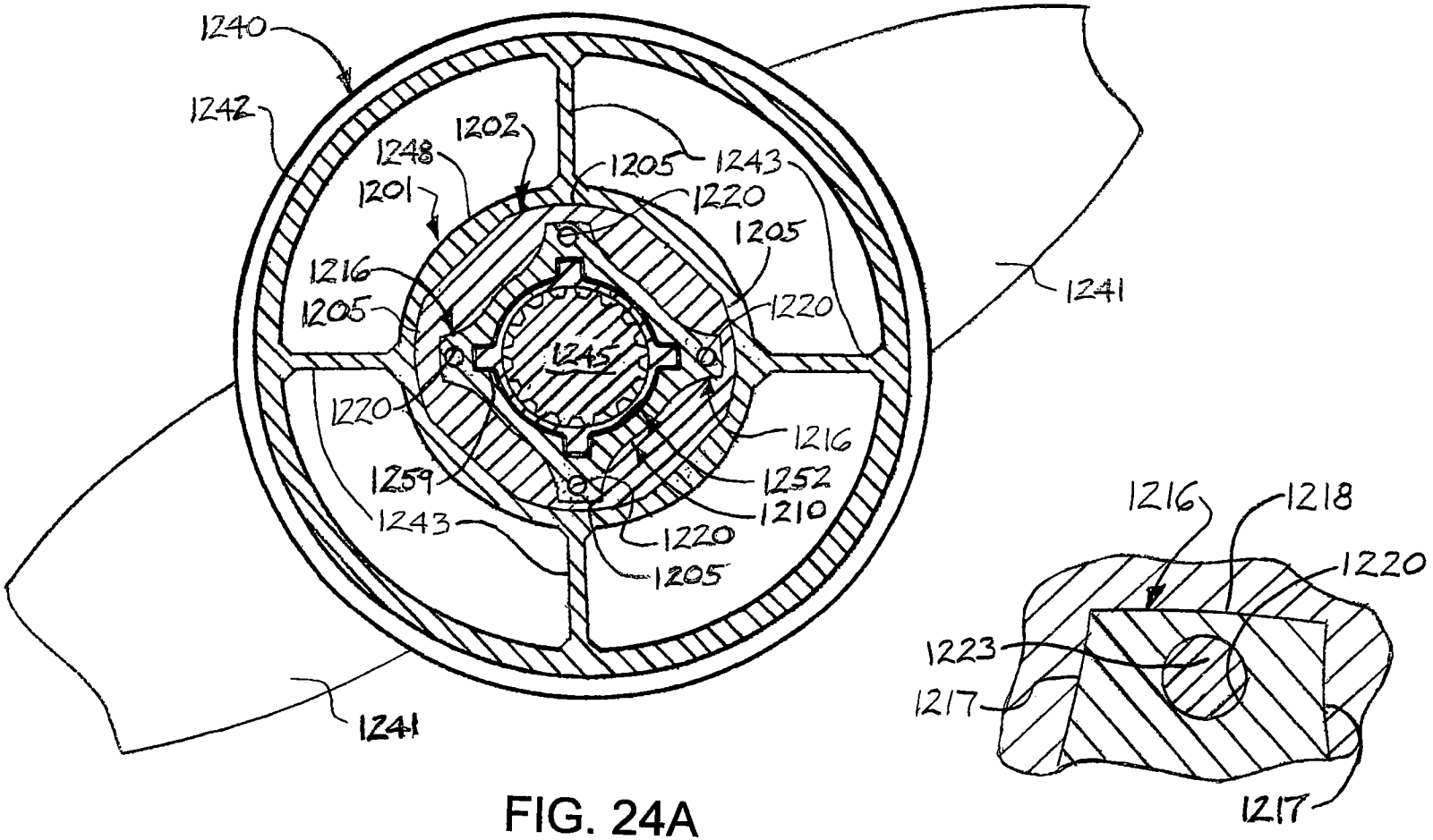
FIG. 24A is a cross-sectional view of another alternative marine propeller with shearable drive assembly having at least one enclosed circular shear cavity in each drive rib of the drive core of the assembly.
FIG. 24B is an enlarged sectional view of a typical drive rib on the drive core of the marine propeller with shearable drive assembly illustrated in FIG. 25A, more particularly illustrating the enclosed circular shear cavity in the drive rib and a cavity material in the shear cavity.

Referring next to FIGS. 24A and 24B of the drawings, another alternative illustrative embodiment of the marine propellers with shearable drive assemblies is generally indicated by reference numeral 1240. In the shearable drive assembly 1201 of the marine propeller 1240, elements analogous to the respective elements of the shearable drive assembly 1 that was heretofore described with respect to FIGS. 1-9 are designated by the same respective numerals in the 1201-1299 series in FIGS. 24A and 24B.

At least one enclosed shear cavity 1220 may extend into, through or within at least one drive rib 1216 on the drive core 1210. As used herein, "enclosed" means that the shear cavity 1220 is entirely enclosed within the drive rib 1216 and does not open to either of the side rib surfaces 1217 or the outer rib surface 1218 of the drive rib 1216. Each enclosed shear cavity 1220 may alter the shear resistance characteristics of one or more of the drive ribs 1216 in application of torsional forces from the propeller drive shaft 1245 to the propeller hub 1242 of the marine propeller 1240 via the drive core 1210 and the drive sleeve 1202, respectively, of the shearable drive assembly 1201.

Each enclosed shear cavity 1220 may have any desired cross-sectional shape to impart the desired shear resistance characteristics or properties to each drive rib 1216. For example and without limitation, as illustrated in FIG. 24A and will be hereinafter further described, each enclosed shear cavity 1220 may have a circular cross-section. In other embodiments, each enclosed shear cavity 1220 may have a triangular, square or other polygonal or non-polygonal cross-sectional shape.

As illustrated in FIG. 24B, in some embodiments, at least one cavity material 1223 may be provided in the enclosed shear cavity 1220 of each drive rib 1216. The cavity material 1223 may include air; at least one or a combination of elastomeric materials such as rubber, plastic and/or composite materials; and/or at least one or a combination of rigid or semirigid materials such as plastic, composites and/or metals, for example and without limitation. In some embodiments, elastomeric, rigid and/or semirigid materials may be combined in selected ratios and/or positions within each enclosed shear cavity 1220 to achieve the desired shear capability or characteristics of each drive rib 1216. Application of the marine propeller 1240 with the shearable drive assembly 1201 may be as was heretofore described with respect to the marine propeller 1 having the shearable drive assembly 1 in FIGS. 1-9.

Figure 25B:
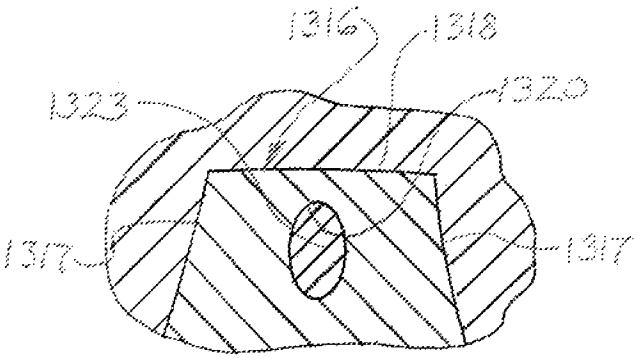
FIG. 25B is an enlarged sectional view of a typical drive rib on the drive core of the marine propeller with shearable drive assembly illustrated in FIG. 25A, more particularly illustrating the enclosed oval shear cavity in the drive rib and a cavity material in the shear cavity.
Figure 25A:
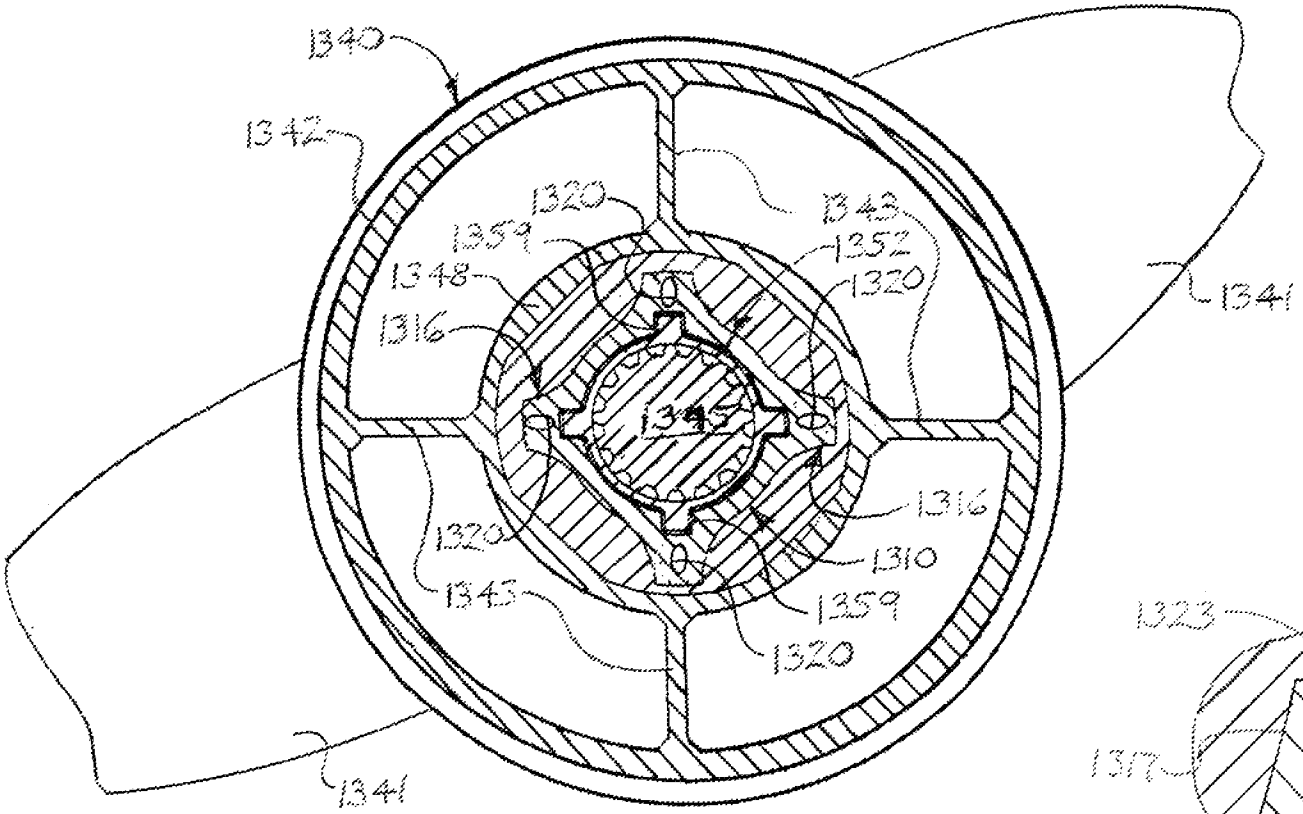
FIG. 25A is a cross-sectional view of another alternative marine propeller with shearable drive assembly having at least one enclosed oval shear cavity in each drive rib of the drive core of the assembly.

Referring next to FIGS. 25A and 25B of the drawings, another alternative illustrative embodiment of the marine propellers with shearable drive assemblies is generally indicated by reference numeral 1340. In the shearable drive assembly 1301 of the marine propeller 1340, elements analogous to the analogous to the respective elements of the shearable drive assembly 1 that was heretofore described with respect to FIGS. 1-9 are designated by the same respective numerals in the 1301-1399 series in FIGS. 25A and 25B.

At least one oval or elliptical enclosed shear cavity 1320 may extend into, through or within at least one drive rib 1316 on the drive core 1310. Accordingly, as illustrated in FIG. 25B, the oval or elliptical enclosed shear cavity 1320 is not open to either of the side rib surfaces 1317 or the outer rib surface 1318 of the drive rib 1316. Each oval or elliptical closed shear cavity 1320 may alter the shear resistance characteristics of one or more of the drive ribs 1316 in application of torsional forces from the propeller drive shall 1345 to the propeller hub 1342 of the marine propeller 1340 via the drive core 1310 and the drive sleeve 1302, respectively, of the shearable drive assembly 1301.

As illustrated in FIG. 25B, in some embodiments, at least one cavity material 1323 may be provided in the oval or elliptical enclosed shear cavity 1320 of each drive rib 1316. The cavity material 1323 may include air; at least one or a combination of elastomeric materials such as rubber, plastic and/or composite materials; and/or at least one or a combination of rigid or semirigid materials such as plastic, composites and/or metals, for example and without limitation. In some embodiments, elastomeric, rigid and/or semirigid materials may be combined in selected ratios and/or positions within each shear cavity 1320 to achieve the desired shear capability or characteristics of each drive rib 1316. Application of the marine propeller 1340 having the shearable drive assembly 1301 may be as was heretofore described with respect to the marine propeller 1 having the shearable drive assembly 1 in FIGS. 1-9.

While the preferred embodiments of the invention have been described above, it will be recognized and understood that various modifications may be made in the invention and the appended claims are intended to cover all such modifications which may fall within the spirit and scope of the invention.

What is claimed is:

1. A marine propeller for coupling to a propeller drive shaft, comprising:

a propeller hub;

a plurality of propeller blades extending from the propeller hub; and a shearable drive assembly comprising:

a drive core comprising:

a core wall configured to be drivingly engaged by the propeller drive shaft;

at least one drive rib extending from the core wall, the at least one drive rib forming an integral monolithic part with the core wall; and at least one shear cavity in the at least one drive rib; and a drive sleeve drivingly engaged for rotation by the drive core and drivingly engaging the propeller hub of the marine propeller for rotation, the drive sleeve having at least one rib slot receiving the at least one drive rib of the drive core.

2. The marine propeller of claim 1 wherein the at least one drive rib comprises a rib base extending from the core wall of the drive core, a pair of spaced-apart side rib surfaces extending from the rib base and an outer rib surface extending between the side rib surfaces.

3. The marine propeller of claim 2 wherein the at least one shear cavity comprises at least one unenclosed shear cavity extending into the drive rib from the outer rib surface.

4. The marine propeller of claim 3 wherein the at least one unenclosed shear cavity has a U-shaped cross-section.

5. The marine propeller of claim 3 wherein the at least one unenclosed shear cavity comprises a flat or planar inner cavity surface and stepped side cavity surfaces extending from the inner cavity surface to the outer rib surface of the at least one drive rib.

6. The marine propeller of claim 2 wherein the rib base has sharp concave corners extending longitudinally along the drive core at the side rib surfaces, respectively, of the at least one drive rib.

7. The marine propeller of claim 2 wherein the rib base has a convex profile along the drive core at the side rib surfaces, respectively, of the at least one drive rib.

8. The marine propeller of claim 1 wherein the at least one shear cavity comprises a plurality of shear cavity segments extending in a sequential linear pattern.

9. The marine propeller of claim 1 further comprising at least one rib shear channel in the at least one drive rib of the drive core.

10. A marine propeller for coupling to a propeller drive shaft, comprising:
- a propeller hub;
- a plurality of propeller blades extending from the propeller hub; and
- a shearable drive assembly comprising:
  - a drive core comprising:
    - a core wall configured to be drivingly engaged by the propeller drive shaft;
    - at least one drive rib extending from the core wall;
    - at least one rib shear channel in the at least one drive rib of the drive core, wherein the at least one drive rib comprises a rib base extending from the core wall of the drive core, a pair of spaced-apart side rib surfaces extending from the rib base and an outer rib surface extending between the side rib surfaces, and the at least one rib shear channel comprises a pair of rib shear channels extending through the drive rib at the rib base;
    - at least one shear cavity in the at least one drive rib; and
  - a drive sleeve drivingly engaged for rotation by the drive core and drivingly engaging the propeller hub of the marine propeller for rotation, the drive sleeve having at least one rib slot receiving the at least one drive rib of the drive core.

11. The marine propeller of claim 1 further comprising at least one cavity material in the at least one shear cavity.

12. The marine propeller of claim 1 further comprising a shaft bore formed by the core wall and a plurality of shaft bore splines extending from the core wall into the shaft bore, and wherein the propeller drive shaft is configured to drivingly engage the drive core through the plurality of shaft bore splines.

13. The marine propeller of claim 1 further comprising a drive adaptor configured to be drivingly engaged by the propeller drive shaft and drivingly engaging the drive core of the shearable drive assembly for rotation.

14. The marine propeller of claim 1 wherein the at least one shear cavity comprises at least one enclosed shear cavity.

15. The marine propeller of claim 14 wherein the at least one enclosed shear cavity has a circular cross-section.

16. The marine propeller of claim 14 wherein the at least one enclosed shear cavity has an oval or elliptical cross-section.

17. The marine propeller of claim 1 wherein the propeller hub is polygonal in cross-section.

18. A marine propeller for coupling to a propeller drive shaft, comprising:
- a propeller hub;
- a plurality of propeller blades extending from the propeller hub; and
- a shearable drive assembly comprising:
  - a drive core comprising:
    - a core wall configured to be drivingly engaged by the propeller drive shaft;
    - at least one drive rib extending from the core wall;
    - at least one sacrificial rib extending from the core wall; and
    - a drive sleeve drivingly engaged for rotation by the drive core and drivingly engaging the propeller hub of the marine propeller for rotation, the drive sleeve having at least one rib slot receiving the at least one drive rib and at least one rib slot receiving the at least one sacrificial rib of the drive core.

19. The marine propeller of claim 18 wherein the at least one sacrificial rib comprises a pair of sacrificial ribs extending from the core wall in spaced-apart relationship to each other.

20. The marine propeller of claim 18 wherein the at least one sacrificial rib extends from the core wall of the drive core immediately adjacent to and angling away from the at least one drive rib in a forward rotational direction of the propeller hub.

21. The marine propeller of claim 18 wherein the at least one sacrificial rib extends from the core wall of the drive core immediately adjacent to and angling away from the at least one drive rib in a reverse rotational direction of the propeller hub.

22. The marine propeller of claim 18 further comprising at least one overlapping shear channel extending longitudinally within and along the at least one sacrificial rib in overlapping relationship to the drive sleeve.

23. The marine propeller of claim 18 further comprising at least one rib shear channel in at least one of the at least one drive rib and the at least one sacrificial rib of the drive core.

24. A marine propeller for coupling to a propeller drive shaft, comprising:
- a propeller hub having at least one interior lug slot;
- a plurality of propeller blades extending from the propeller hub; and
- a shearable drive assembly comprising:
  - a drive core comprising:
    - a core wall configured to be drivingly engaged by the propeller drive shaft; and
    - at least one drive rib extending from the core wall;
  - a drive sleeve drivingly engaged for rotation by the drive core and drivingly engaging the propeller hub of the marine propeller for rotation, the drive sleeve having at least one interior rib slot receiving the at least one drive rib of the drive core and at least one exterior sleeve lug inserted in the at least one interior lug slot in the propeller hub; and
  - wherein the drive core is circumferentially offset with respect to the drive sleeve with the at least one drive rib corresponding positionally and off-center with respect to a corresponding one of the at least one exterior sleeve lug of the drive sleeve.

25. The marine propeller of claim 24 wherein the at least one drive rib is off-center with respect to the at least one exterior sleeve lug away from a forward rotational direction of the propeller hub.

26. The marine propeller of claim 24 wherein the at least one drive rib is off-center with respect to the at least one exterior sleeve lug away from a reverse rotational direction of the propeller hub.

27. A marine propeller for coupling to a propeller drive shaft, comprising:

a propeller hub;

a plurality of propeller blades extending from the propeller hub; and a shearable drive assembly comprising:

a drive core comprising:

a core wall configured to be drivingly engaged by the propeller drive shaft;

at least one drive rib extending from the core wall, the at least one drive rib comprising a rib base extending from the core wall of the drive core, a pair of spaced-apart side rib surfaces extending from the rib base and an outer rib surface extending between the side rib surfaces; and at least one shear cavity in the at least one drive rib, the at least one shear cavity comprising at least one unenclosed shear cavity extending into the drive rib from the outer rib surface, wherein the at least one unenclosed shear cavity comprises a flat or planar inner cavity surface and stepped side cavity surfaces extending from the inner cavity surface to the outer rib surface of the at least one drive rib; and a drive sleeve drivingly engaged for rotation by the drive core and drivingly engaging the propeller hub of the marine propeller for rotation, the drive sleeve having at least one rib slot receiving the at least one drive rib of the drive core.

28. A marine propeller for coupling to a propeller drive shaft, comprising:

a propeller hub including a propeller hub drive sleeve having a plurality of interior lug slots and a plurality of interior hub drive sleeve flats alternating with the plurality of interior lug slots;

a plurality of propeller blades extending from the propeller hub; and a shearable drive assembly comprising:

a drive core comprising:

a core wall configured to be drivingly engaged by the propeller drive shaft; and a plurality of drive ribs extending from the core wall;

a drive sleeve drivingly engaged for rotation by the drive core and drivingly engaging the propeller hub drive sleeve of the propeller hub of the marine propeller for rotation, the drive sleeve having a plurality of interior rib slots receiving the plurality of drive ribs, respectively, of the drive core, a plurality of exterior sleeve lugs inserted in the plurality of interior lug slots, respectively, in the propeller hub drive sleeve, and a plurality of exterior sleeve flats alternating with the plurality of exterior sleeve lugs, respectively, and engaging the plurality of interior hub drive sleeve flats, respectively; and wherein the drive core is circumferentially offset with respect to the drive sleeve with the plurality of drive ribs corresponding positionally and off-center with respect to the plurality of exterior sleeve lugs, respectively, of the drive sleeve and the plurality of interior lug slots, respectively, of the propeller hub drive sleeve of the propeller hub.

* * * * *